US009512627B2

(12) United States Patent
Taron

(10) Patent No.: US 9,512,627 B2
(45) Date of Patent: Dec. 6, 2016

(54) COLLAPSIBLE SAW HORSE

(76) Inventor: L. Michael Taron, Cottonwood, AZ (US)

( * ) Notice: Subject to any disclaimer, the term of this patent is extended or adjusted under 35 U.S.C. 154(b) by 0 days.

(21) Appl. No.: 12/777,039

(22) Filed: May 10, 2010

(65) Prior Publication Data

US 2011/0272213 A1 Nov. 10, 2011

(51) Int. Cl.
*E04G 1/34* (2006.01)
*B25H 1/04* (2006.01)

(52) U.S. Cl.
CPC .. *E04G 1/34* (2013.01); *B25H 1/04* (2013.01)

(58) Field of Classification Search
CPC ..... B25H 1/02; B25H 1/04; B25H 1/06
USPC ..... 182/153, 155, 181.1, 186.2, 186.4, 224
See application file for complete search history.

(56) References Cited

U.S. PATENT DOCUMENTS 295,269 A * 3/1884 Miller ..... B25H 1/06 182/153
319,723 A * 6/1885 Hughes ..... B25H 1/06 182/185.1
862,725 A * 8/1907 Fietsam ..... B25H 1/06 182/155
1,476,855 A 12/1923 Topp
1,479,209 A 1/1924 Topp
1,604,824 A 10/1926 Hoen
1,842,012 A 1/1932 Cline
2,427,679 A * 9/1947 Larson ..... B25H 1/06 182/153
2,544,989 A 3/1951 Garibaldi
2,594,464 A 4/1952 Loucks, Jr.
2,635,013 A 4/1953 Doucette
2,644,726 A 7/1953 Miller
2,664,319 A 12/1953 Doucette
2,824,771 A 2/1958 Blenski
3,016,104 A 1/1962 Johnson
3,040,834 A 6/1962 Dakin
3,078,956 A 2/1963 Larson
3,078,957 A 2/1963 Larson
3,241,633 A 3/1966 Bond et al.
3,276,545 A 10/1966 D'Angelo
3,282,379 A * 11/1966 Jones ..... B25H 1/06 182/155
3,414,080 A 12/1968 Doucette
3,443,662 A * 5/1969 Thompson ..... E04G 1/34 182/155
3,529,697 A * 9/1970 White ..... B25H 1/06 182/186.2
3,599,751 A 8/1971 Mueller
3,631,941 A 1/1972 Greenman et al.
3,633,709 A 1/1972 Weser
3,682,272 A 8/1972 Secor
3,716,112 A * 2/1973 Lake ..... B25H 1/06 182/155

(Continued)

FOREIGN PATENT DOCUMENTS

DE EP0391115 A2 * 10/1990 ..... B23D 47/025
FR 2898399 A1 * 9/2007 ..... B25H 1/06
TW DE202011106462 U1 * 1/2012 ..... A47B 3/087

*Primary Examiner* — Katherine Mitchell
*Assistant Examiner* — Candace L Bradford
(74) *Attorney, Agent, or Firm* — Wayne Carroll; Inspired Idea Solutions Law Firm

(57) ABSTRACT

A saw horse may include a center beam, a first leg connected to the center beam, and a second leg connected to the center beam. The first leg may rotate and may traversely extend and retract to move between an open and a stowed position. The second leg may rotate and traversely extend and retract to move between the open and the stowed position. The saw horse may include a flexible axis biasing device to connect to the first leg. The saw horse may include a flexible axis biasing device to connect to the second leg.

30 Claims, 31 Drawing Sheets

(56) References Cited

U.S. PATENT DOCUMENTS

| | | | | | |
|---|---|---|---|---|---|
| 3,734,235 | A | | 5/1973 | Lanier | |
| 3,741,338 | A | * | 6/1973 | Durand | B66C 19/02 182/141 |
| 3,741,339 | A | | 6/1973 | Eubank | |
| 3,763,958 | A | | 10/1973 | Hanson | |
| 3,810,527 | A | | 5/1974 | Kramer | |
| 3,817,349 | A | * | 6/1974 | Barthel | B25H 1/06 182/155 |
| 3,887,036 | A | | 6/1975 | Telban | |
| 3,951,233 | A | | 4/1976 | Meyers | |
| 4,030,565 | A | * | 6/1977 | Chaput | B25H 1/06 182/151 |
| D251,018 | S | | 2/1979 | Lockwood | |
| 4,182,432 | A | * | 1/1980 | Cossitt | B25H 1/06 182/151 |
| 4,238,001 | A | | 12/1980 | Alexander | |
| 4,245,718 | A | | 1/1981 | Poston et al. | |
| 4,325,463 | A | * | 4/1982 | Taylor | B25H 1/06 182/155 |
| 4,386,678 | A | | 6/1983 | Wendell | |
| 4,403,678 | A | * | 9/1983 | Zieg | B25H 1/06 182/153 |
| 4,429,765 | A | * | 2/1984 | Garcia | B25H 1/06 182/153 |
| 4,461,370 | A | | 7/1984 | Connell | |
| 4,508,194 | A | | 4/1985 | Freewalt et al. | |
| 4,515,243 | A | | 5/1985 | Prior | |
| 4,570,752 | A | | 2/1986 | Chapman et al. | |
| 4,605,099 | A | | 8/1986 | Crum et al. | |
| 4,640,386 | A | | 2/1987 | Hall | |
| 4,756,385 | A | | 7/1988 | Deitz et al. | |
| 4,770,274 | A | | 9/1988 | Middleton | |
| 4,771,863 | A | * | 9/1988 | Stansberry | B25H 1/06 182/155 |
| 4,819,762 | A | * | 4/1989 | Osborne, Sr. | B25H 1/06 182/153 |
| 4,880,080 | A | | 11/1989 | Brockman | |
| 4,884,658 | A | | 12/1989 | Banfield | |
| 4,926,966 | A | | 5/1990 | Boudreau | |
| 4,967,877 | A | * | 11/1990 | Wallman | B25H 1/06 182/155 |
| 5,096,019 | A | | 3/1992 | Kelsay | |
| D325,639 | S | | 4/1992 | Tavella | |
| 5,119,903 | A | * | 6/1992 | Ulshafer, Jr. | B25H 1/06 182/155 |
| 5,170,861 | A | | 12/1992 | Turner | |
| 5,297,655 | A | | 3/1994 | Wolfe | |
| D352,788 | S | | 11/1994 | Sheftel | |
| 5,377,779 | A | * | 1/1995 | Slapnicka | E04G 1/34 182/153 |
| 5,402,860 | A | | 4/1995 | Fry | |
| D362,510 | S | | 9/1995 | Jones | |
| 5,542,639 | A | | 8/1996 | Wixey et al. | |
| 5,560,448 | A | * | 10/1996 | Yemini | B25H 1/12 182/153 |
| 5,582,267 | A | | 12/1996 | Bockoven et al. | |
| D378,544 | S | | 3/1997 | Aldredge | |
| 5,704,450 | A | | 1/1998 | Lunceford | |
| 5,803,205 | A | | 9/1998 | Kochem | |
| 5,921,347 | A | | 7/1999 | Rodriguez et al. | |
| 6,142,256 | A | | 11/2000 | Dirk, II | |
| 6,145,800 | A | | 11/2000 | Watkins | |
| 6,564,903 | B2 | | 5/2003 | Krajec | |
| 6,601,675 | B2 | | 8/2003 | Gulledge | |
| 6,640,930 | B1 | * | 11/2003 | Peters | B25H 1/06 182/151 |
| 6,675,722 | B2 | | 1/2004 | Stathis et al. | |
| 6,755,282 | B1 | | 6/2004 | Herold | |
| 6,810,966 | B1 | | 11/2004 | Bauer et al. | |
| 6,817,445 | B2 | * | 11/2004 | Slemmer | 182/154 |
| 6,892,859 | B2 | | 5/2005 | Van Der Pol | |
| 6,941,655 | B1 | | 9/2005 | Bisland | |
| 6,968,790 | B1 | | 11/2005 | Kocsis | |
| D535,758 | S | | 1/2007 | Spreadborough | |
| 7,172,053 | B2 | * | 2/2007 | Slavich | B25H 1/06 182/153 |
| 7,185,733 | B2 | | 3/2007 | Widmer | |
| 7,185,738 | B1 | | 3/2007 | Clepper | |
| 7,320,383 | B1 | | 1/2008 | Plate | |
| 2002/0011381 | A1 | | 1/2002 | Wilkerson | |
| 2002/0162704 | A1 | | 11/2002 | Rump | |
| 2002/0166725 | A1 | | 11/2002 | Gulledge | |
| 2003/0172853 | A1 | | 9/2003 | Stathis et al. | |
| 2004/0188178 | A1 | * | 9/2004 | Slemmer | B25H 1/04 182/154 |
| 2005/0199443 | A1 | | 9/2005 | Slavich | |
| 2005/0224291 | A1 | | 10/2005 | Fasanella | |
| 2005/0230188 | A1 | | 10/2005 | Berg | |
| 2006/0124395 | A1 | * | 6/2006 | Fisher | B25H 1/06 182/153 |
| 2006/0137938 | A1 | | 6/2006 | Hayes | |
| 2006/0162627 | A1 | * | 7/2006 | Alger | A47B 3/087 108/169 |
| 2006/0254858 | A1 | | 11/2006 | Rosewicz | |
| 2007/0221817 | A1 | * | 9/2007 | Chen | B25H 1/04 248/676 |
| 2008/0035427 | A1 | * | 2/2008 | Fowler | B25H 1/06 182/153 |
| 2008/0173498 | A1 | * | 7/2008 | Beyor | B25H 1/06 182/153 |
| 2008/0236946 | A1 | | 10/2008 | Stephens | |
| 2008/0302604 | A1 | | 12/2008 | Kramer | |
| 2009/0107767 | A1 | | 4/2009 | Long | |
| 2009/0183948 | A1 | | 7/2009 | Sciorrotta, Jr. | |
| 2009/0260921 | A1 | | 10/2009 | Osborne | |
| 2009/0272861 | A1 | | 11/2009 | Bevelacqua | |

* cited by examiner

COLLAPSIBLE SAW HORSE

FIELD OF THE INVENTION

The present invention relates to a saw horse and more particularly to a saw horse having legs which may pivot and be folded to a compact footprint.

BACKGROUND

The use of saw horse devices is known in the prior art. More specifically, saw horse devices heretofore utilized are known to consist basically of familiar, expected and structural configurations, notwithstanding the myriad of designs encompassed by the crowded prior art which have been developed for the fulfillment of countless objectives and requirements.

The saw horse is a general purpose support device well known in the construction trades. A typical saw horse includes two pairs of legs with a cross beam mounted between the pairs, each pair of legs describing a generally triangular shape with the ground. At least one board may be disposed on top of a pair of saw horses, either as a work piece or as a work surface or as a small scaffolding. The portability, versatility, and economical construction of saw horses provide great utility.

Various modifications in the design and construction of saw horses have been proposed to accomplish these objectives.

Accordingly, a need remains for a saw horse that is that is sturdy and durable, yet easy to set-up, use, and store.

SUMMARY

A saw horse may include a center beam, a first leg connected to the center beam, and a second leg connected to the center beam.

The first leg may rotate and may traversely extend and retract to move between an open and a stowed position.

The second leg may rotate and traversely extend and retract to move between the open and the stowed position.

The saw horse may include a flexible axis biasing device to connect to the first leg.

The saw horse may include a flexible axis biasing device to connect to the second leg.

The saw horse may include a leg spacer to space the first leg and the second leg.

The first leg may include a notch to cooperate with the leg spacer.

The second leg may include a notch to cooperate with the leg spacer.

The first leg and the second leg may be nestable.

The saw horse may include a flexible handle connected to the center beam.

The saw horse may include a leg latch.

The saw horse may include a leg latch catch.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention includes a collapsible/foldable saw horse design that is strong, light weight, easy and quick to collapse for storage and to open up for use. The saw horse is very compact with regular angles for example rectangular in a storage section which allows for stacking of multiple units or standing on either end occupying very little floor area for storage.

The present invention includes a flexible axis spring which attaches the legs to the beam and serves as an axis on which the legs may turn when moving between the storage and in use positions. The flexible axis spring allows the angle of attachment, the length of the axis and the tension on connection to change in variable amounts as legs are moved from flat against the beam (substantially parallel) to be angularly opposed to the beam while being used. The legs may be positioned longitudinally and stabilized while in the open position where a horizontal cross latch locks the legs into position while the notches of the legs cooperate with the spreaders on the beam.

The flexible axis spring allows a range of angles of opposition and angular disposition of the legs with respect to each other.

The sawhorse of the present invention may be formed from planar material such as wood and results in a light weight compact saw horse in storage which is easy and quick to fold and unfold.

The legs and center beam can employ I beam/T beam technology to allow for leg design that may overlay one leg to another to lie side-by-side against the beam for compact storage. Alternatively, a nesting design can be employed. The sawhorse handle facilitates stacking of multiple units and is comfortable to the hand. Alternatively, a rigid handle could be used.

The present invention can be used with a bracket to provide increased strength, especially in applications using wood for the beams and legs. The brackets allow for a broken beam or legs to be changed in case of damage. Furthermore, the bracket provides a low-cost unassembled unit.

It has long been noted that the convenience and functionality of the saw horse may be improved by departing from rigid structural designs. It has been found desirable to provide the saw horse with pivoting or collapsible members for convenient storage. It is further desirable to construct a saw horse from light weight materials to provide ease in transportation. Yet another desirable feature is some means for maintaining the saw horse in a stable and balanced position on a sloping ground surface.

Figure 1:
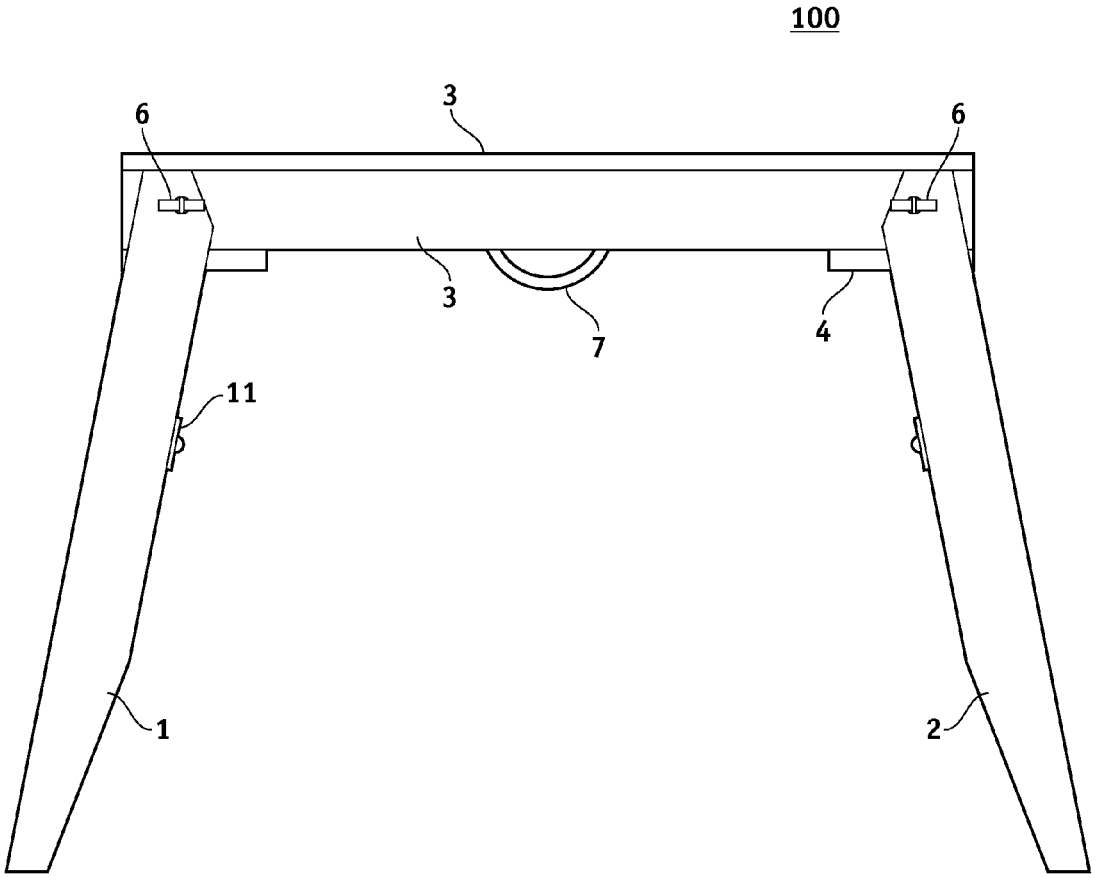
FIG. 1 illustrates a perspective view of the saw horse of the present invention.

FIG. 1 illustrates a saw horse 100 which may include a first leg 1 and a second leg 2. The first leg 1 and the second leg 2 may include a mirrored first leg 1 and a mirrored second leg 2 which may oppose the first leg 1 and the second leg 2 on the back side of the saw horse 100. The first leg 1 and the second leg 2 may include a tapered portion, and FIG. 1 illustrates the first leg 1 and the opposing second leg 2 being positioned with a angled relationship with the center beam 3. The first leg 1 and the second leg 2 may independently pivot and may extend and retract in the traverse direction with respect to the center beam 3. The first leg 1 and the second leg 2 may pivot to a position substantially parallel to the longitudinal direction of the center beam 3 in order to collapse to a stowed position (not shown in FIG. 1). The center beam 3 may be a sandwiched between the first leg 1 and the mirrored first leg 1 and may be sandwiched between the second leg 2 and the mirrored second leg 2. The first leg 1 and the mirrored first leg 1 may be connected to a flexible axis biasing device 5, not shown in FIG. 1, which may be a spring; likewise the second leg 2 and the mirrored second leg 2 may be connected to another flexible axis biasing device 5, not shown in FIG. 1, which may allow the first leg 1 and the second leg 2 to extend and retract in a traverse direction and to bias the first leg 1 and the second leg 2 inwards towards the center beam 3. A leg spacer 4 may be positioned between the first leg 1 and the mirrored first leg 1 and also a second leg spacer may be positioned between the second leg 2 and the mirrored second leg 2 in order to position the first leg 1 and the second leg 2. A retainer pin 6 may extend through respective ends of the flexible axis biasing device 5, not shown in FIG. 1 in order to fasten the first leg 1 and the second leg 2 to the center beam 3. FIG. 1 additionally illustrates a leg latch 11 which may be positioned along the first leg 1 or alternatively the second leg 2 and may be conveniently positioned at approximately the midpoint of the first leg 1 or the second leg 2. The leg latch 11 may restrain either the first leg 1 or the second leg 2 wherein the first leg 1 or the second leg 2 is in an opened position. FIG. 1 additionally illustrates a flexible handle 7 which may be positioned along the bottom of the center beam 3 in order to provide for convenient carrying of the saw horse 100 and is shown substantially centered on the center beam 3.

Figure 2A:
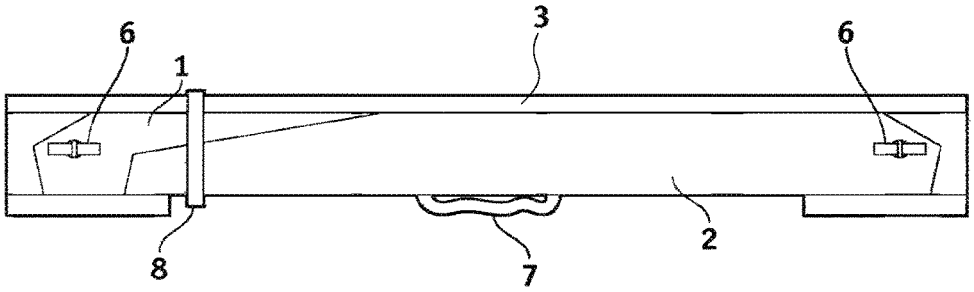
FIG. 2*a* illustrates a side view of the saw horse in a closed position.

FIG. 2*a* shows the first leg 1 and the second leg 2 in a stowed position and shows a fastening device 8 for fastening the first leg 1 and the second leg 2 to the center beam 3, and the fastening device 8 may be a strap which may extend around the first leg 1, the second leg 2 and the center beam 3. Also illustrated is the retainer pin 6, and the flexible handle 7.

Figure 2B:
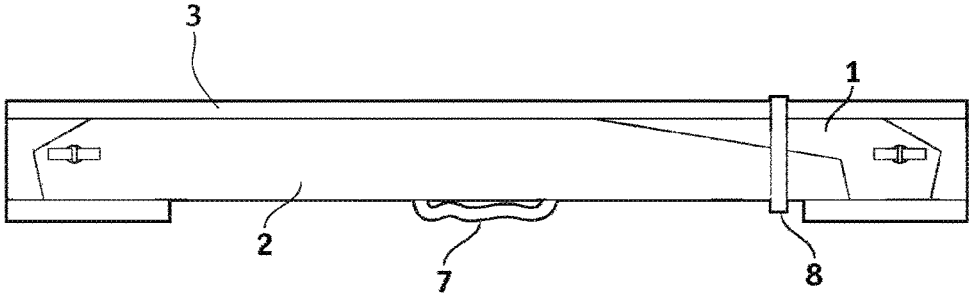
FIG. 2*b* illustrates a cross-sectional view of the saw horse in a closed position.

FIG. 2*b* shows the mirrored first leg 1 and the mirrored second leg 2 in a stowed position and shows a fastening device 8 for fastening the mirrored first leg 1 and the mirrored second leg 2 to the center beam 3, and the fastening device 8 may be a strap which may extend around the mirrored first leg 1, the mirrored second leg 2 and the center beam 3. Also illustrated are the retainer pin 6 and the flexible handle 7.

Figure 3A:
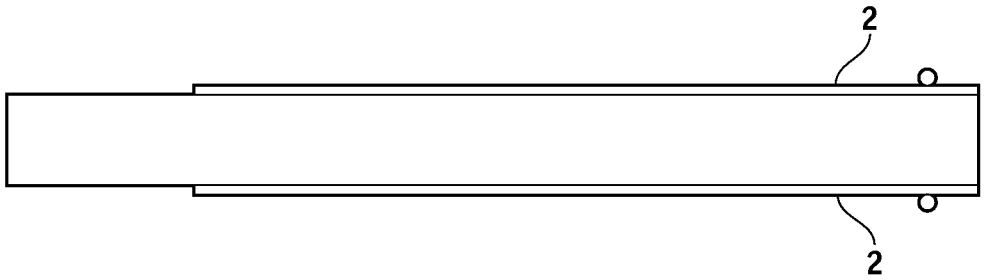
FIG. 3*a* illustrates a top view of the saw horse.

FIG. 3*a* illustrates a top view of the center beam, the mirrored second leg 2, and the second leg 2 in a stowed position.

Figure 3B:
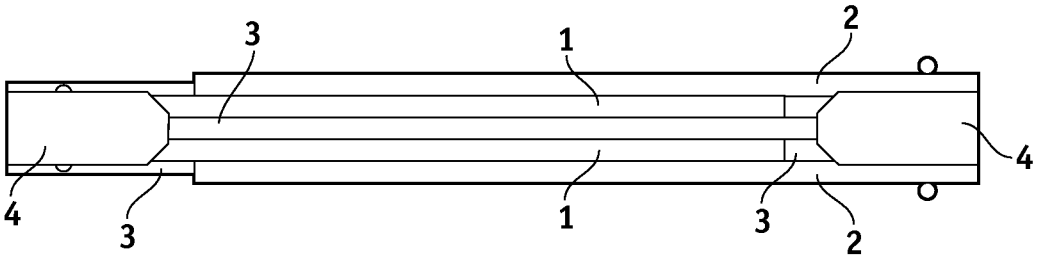
FIG. 3*b* illustrates a bottom view of the saw horse.

FIG. 3*b* illustrates a bottom view of the center beam 3, the second leg 2 on the outside and adjacent to the first leg 1 which may be adjacent to the center beam 3 which may be adjacent to the mirrored first leg 1, which may be adjacent to the mirrored second leg 2, which may be on the outside. The leg spacer 4 is additionally shown in FIG. 3*b*.

Figure 4:
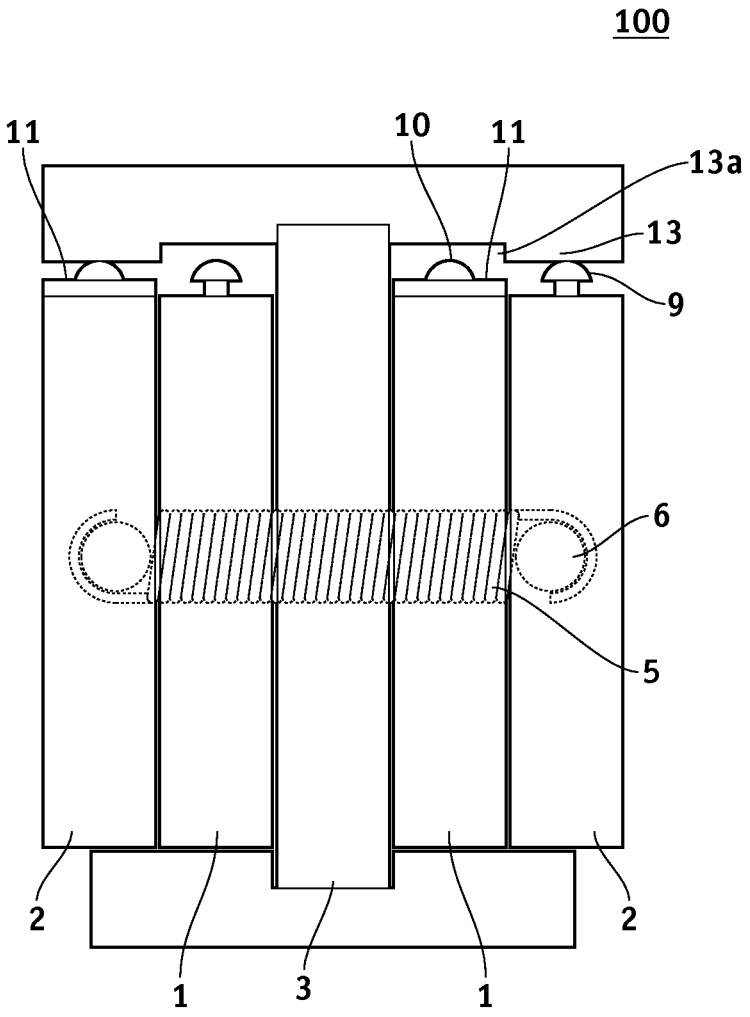
FIG. 4 illustrates an end view of the saw horse.

FIG. 4 illustrates an end (left side in FIG. 3*b*) of the saw horse 100 in a stowed position and illustrates the second leg 2 on the outside, going from right to left, and adjacent to the first leg 1 which may be adjacent to the center beam 3 which may be adjacent to the mirrored first leg 1, which may be adjacent to the mirrored second leg 2 which may be on the outside. FIG. 4 additionally illustrates that the flexible axis biasing device 5 extends through the first leg 1, the center beam, and the mirrored first leg 1, and is connected to the retaining pin 6 at each end. FIG. 4 further illustrates the top leg guide 13 and a stop recess 13*a* to guide the first and mirrored first legs.

Figure 5:
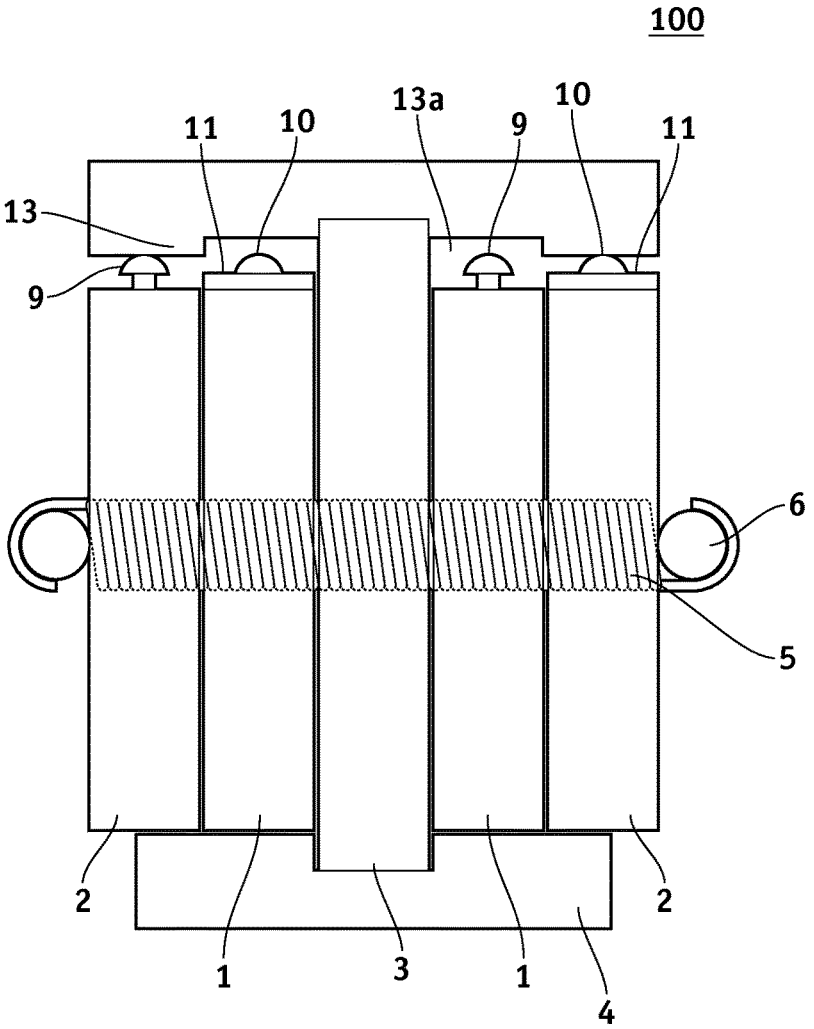
FIG. 5 illustrates another end view of the saw horse.

FIG. 5 illustrates an end (right side in FIG. 3*b*) of the saw horse 100 #100 is not noted on the drawing in a stowed position and illustrates the mirrored second leg 2 (going from right to left) on the outside and adjacent to the mirrored first leg 1 which may be adjacent to the center beam 3 which may be adjacent to the first leg 1, which may be adjacent to the second leg 2 which may be on the outside. FIG. 5 additionally illustrates that the flexible axis biasing device 5 extends through the mirrored second leg 2, the center beam 3, and the second leg 2 and is connected to the retaining pin 6 at each end. FIG. 5 further illustrates the top leg guide 13 and a stop recess 13*a* to guide the mirrored second leg 2 and the second leg 2, and the leg latch catch 9.

Figure 6:
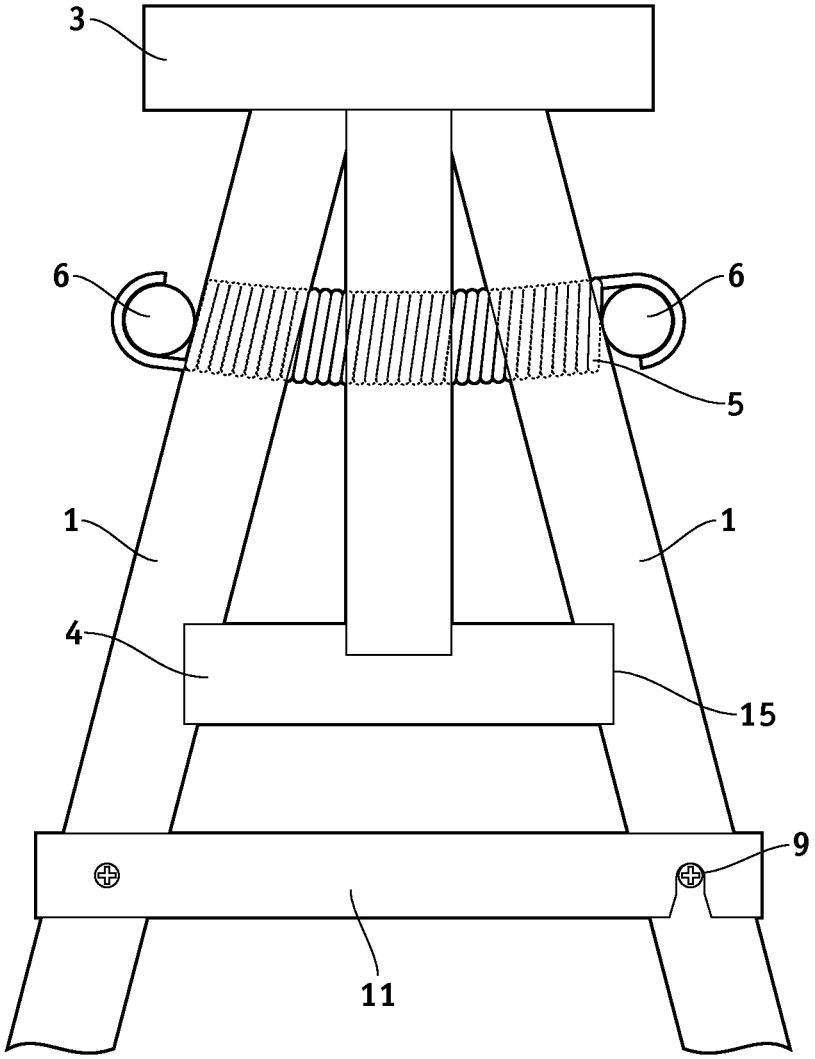
FIG. 6 illustrates a cross-sectional view of a portion of the end of the saw horse.

FIG. 6 illustrates an end of the saw horse (left side in FIG. 3*b*) showing that the first leg 1 and the mirrored first leg 1 may be at a angled relationship with respect to the center beam 3 and illustrates that the first leg 1 and the mirrored first leg 1 may include a leg stabilization notch 15 which may be positioned on the interior surface of the first leg 1 and the mirrored first leg 1 in order to cooperate with the leg spacer 4 which may space and stabilize the first leg 1 and the mirrored first leg 1. FIG. 6 additionally illustrates that the flexible axis biasing device 5 may be approximately arc-shaped in order to allow the first leg 1 and the mirrored first leg 1 to extend outwards. FIG. 6 additionally illustrates a leg latch 11 which is pivotally connected to one of the first leg 1 or the mirrored first leg 1 and the other leg 1, mirrored leg 1 may include a catch 9 to allow the leg latch to connect and support the legs 1, mirrored leg 1.

Figure 7:
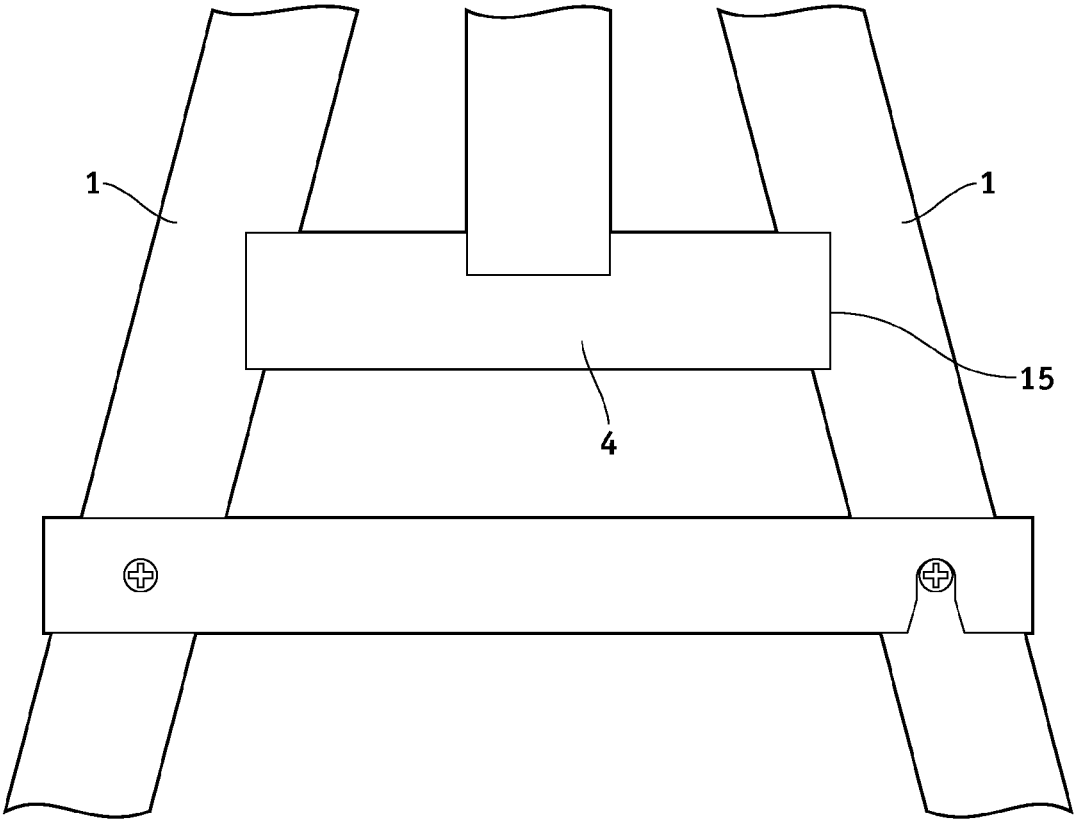
FIG. 7 illustrates a cross-sectional view of another portion of the end of the saw horse.

FIG. 7 illustrates that the first leg 1 and the mirrored first leg 1 may include a leg stabilization notch 15 which may be positioned on the interior surface of the first leg 1 and the mirrored first leg 1 in order to cooperate with the leg spacer 4 which may space and stabilize the first leg 1 and the mirrored first leg 1.

Figure 8:
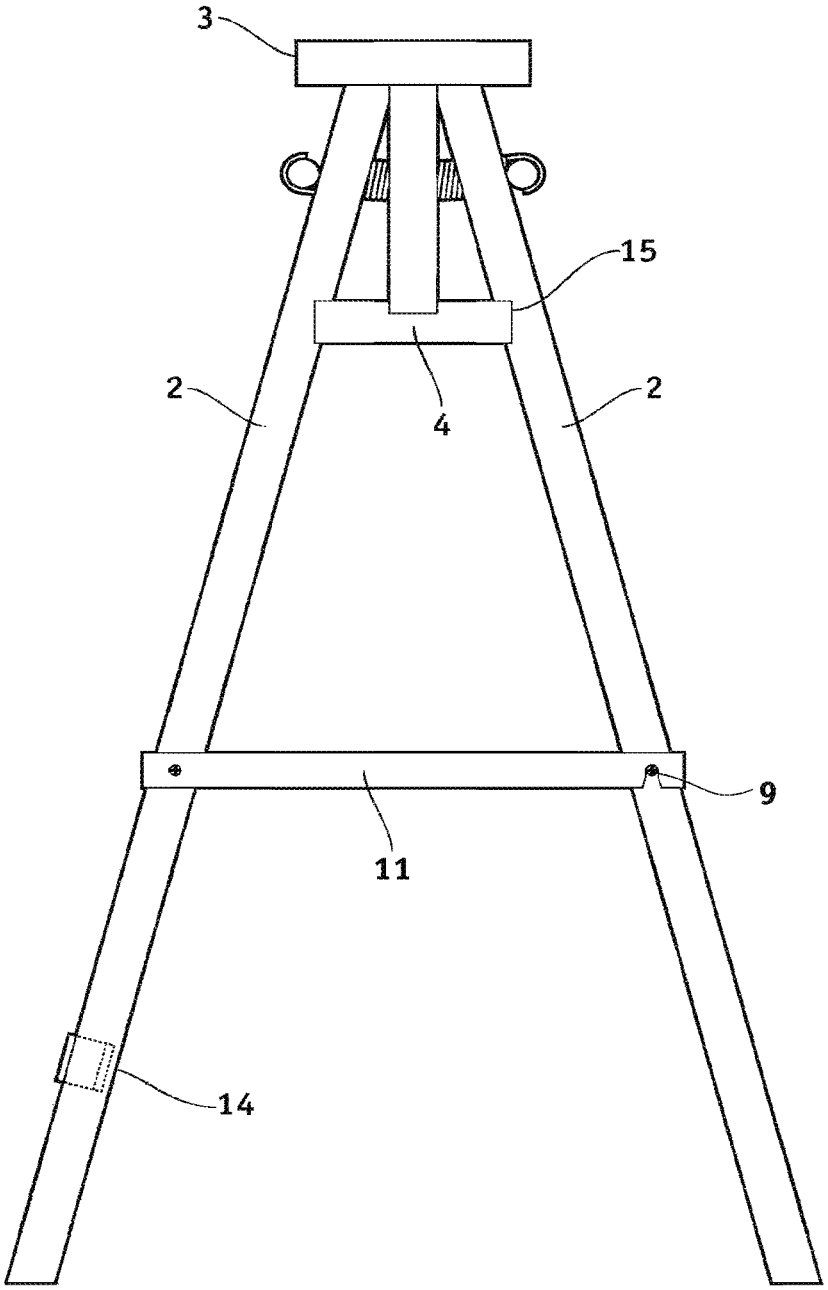
FIG. 8 illustrates a cross-sectional view of the end of the saw horse including the portion of FIG. 7.

FIG. 8 illustrates that the second leg 2 and the mirrored second leg 2 (right side in FIG. 3*b*) may be at a angled relationship with respect to the center beam 3 and illustrates that the second leg 2 and the mirrored second leg 2 may include a leg stabilization notch 15 which may be positioned on the interior surface of the second leg 2 and the mirrored second leg 2 in order to cooperate with the leg spacer 4 which may space and stabilize the second leg 2 and the mirrored second leg 2. FIG. 6 additionally illustrates that the flexible axis biasing device 5 may be approximately arc-shaped in order to allow the second leg 2 and the mirrored second leg 2 to extend outwards. FIG. 8 additionally illustrates a leg latch 11 which is pivotally connected to one of the second leg 2 or the mirrored second leg 2, and the other leg 2, mirrored leg 2 may include a catch 9 to allow the leg latch to connect and support the legs 2, mirrored leg 2. FIG. 8 additionally illustrates a leg latch retainer clip 14 to be used when the legs 1, 2 are in a stowed position. The leg retainer clip 14 attaches to the leg and holds the leg latch 11 stowed against the leg when the saw horse is in the stowed position.

Figure 9:
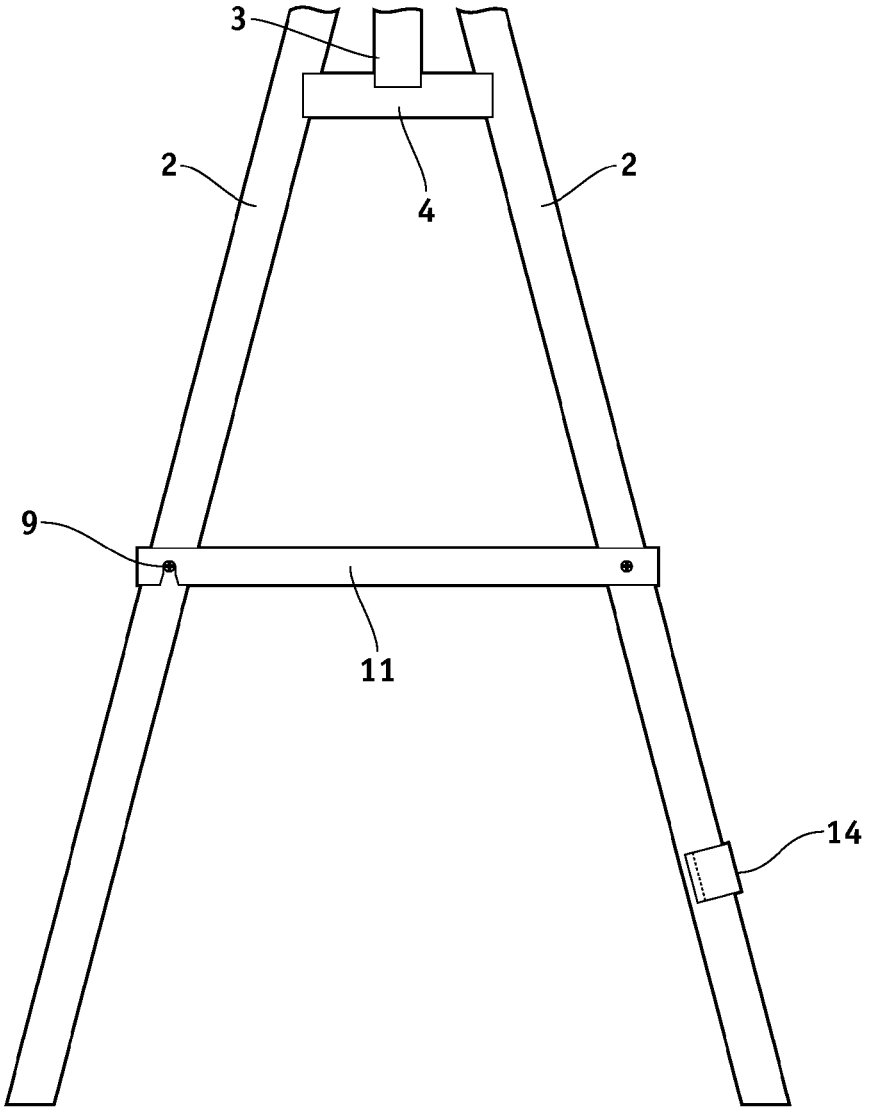
FIG. 9 illustrates a cross-sectional view of another portion of the end of the saw horse.

FIG. 9 illustrates a top view of the leg latch catch 9 to releasably hold the legs 1, mirrored leg 1 in an open position and to release the legs 1, mirrored leg 1 so that the legs 1, mirrored leg 1 can be placed at adjacent and stowed. The leg catch 9 cooperates with the leg latch 11 which may pivot. FIG. 9 additionally illustrates the spacer 4.

Figure 10:
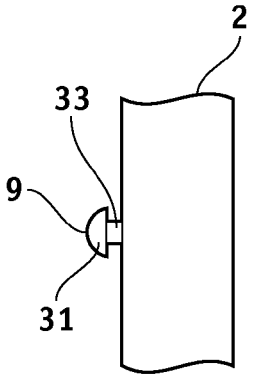
FIG. 10 illustrates a cross-sectional view of the leg latch catch of the saw horse.

FIG. 10 illustrates a side view of the leg 2 which may include the leg latch catch 9 which may include a mushroom shaped head 31 which may be mounted on a rod 33 which may extend into the leg 2.

Figure 11:
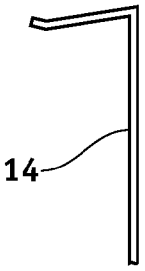
FIG. 11 illustrates a leg latch retainer clip of the saw horse.

FIG. 11 illustrates a side view of the leg latch retainer clip 14 which may be substantially L-shaped.

Figure 12:
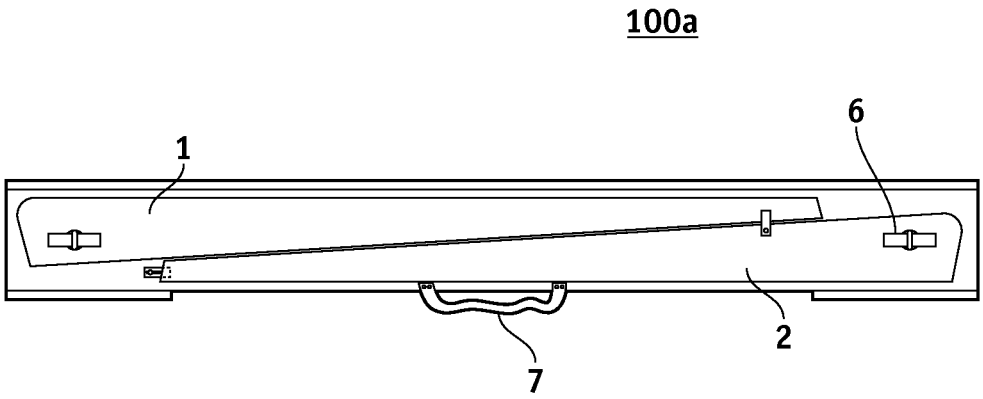
FIG. 12 illustrates a folded saw horse in a closed position.

FIG. 12 illustrates another embodiment of side-by-side legs 1, 2. The sawhorse 100*a* is illustrated in a side view and in a stowed position.

Figure 13:
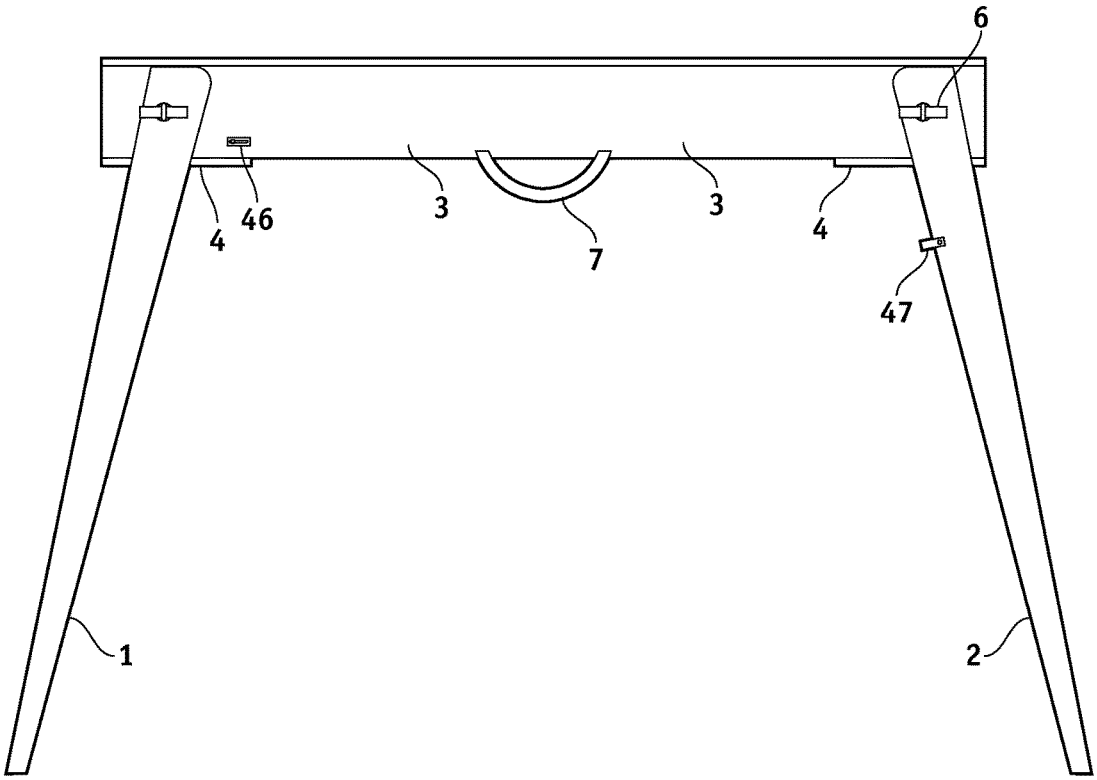
FIG. 13 illustrates a perspective view of the saw horse in the open position.

FIG. 13 illustrates the legs 1, 2, the center beam 3, the leg spacer 4, the retainer pins 6, the flexible handle 7, the fastener device 46 and the leg retainer tab 47.

Figure 14:
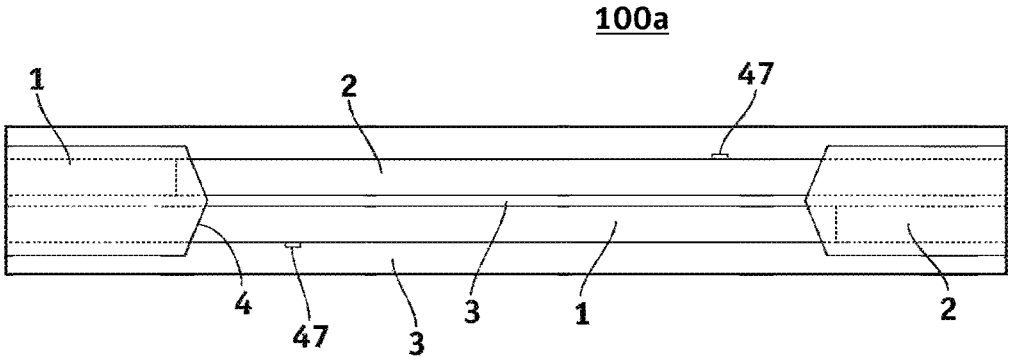
FIG. 14 illustrates a bottom view of the saw horse of the present invention.

FIG. 14 illustrates a bottom view of the sawhorse 100*a* and FIG. 14 illustrates the second leg 2 and the mirrored first leg 1 the center beam 3, the leg spacer 4, and the leg retainer tab 47.

Figure 15:
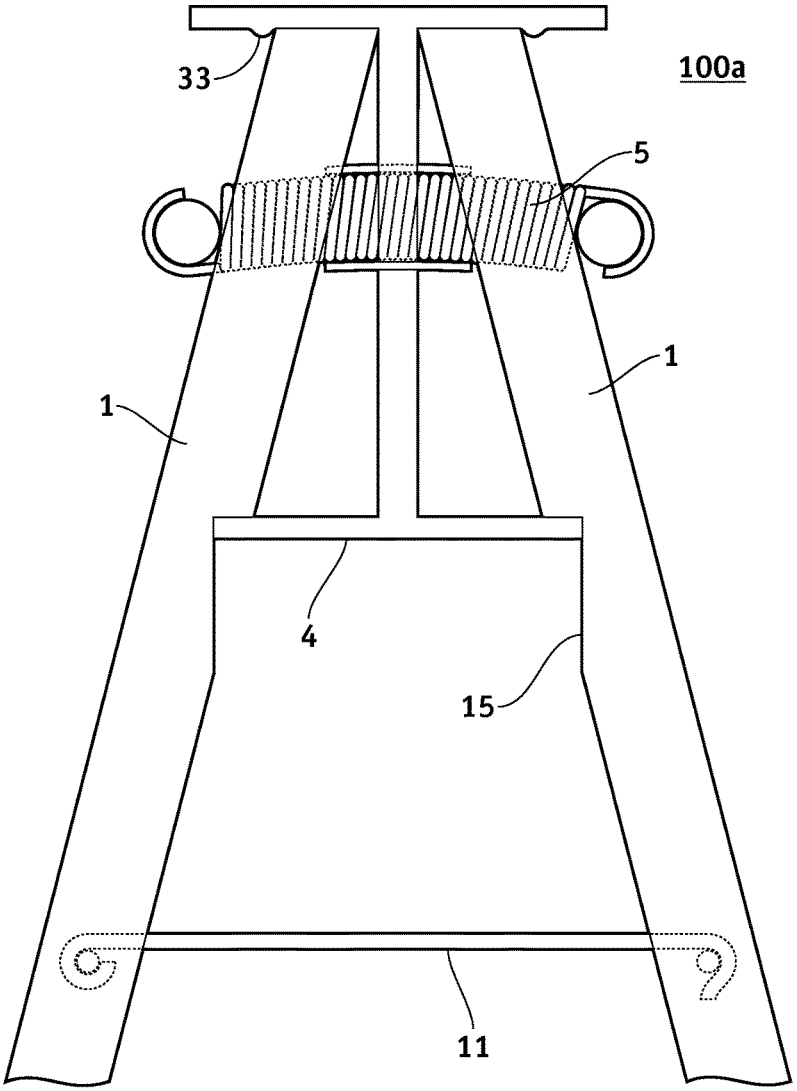
FIG. 15 illustrates an end view of a portion of the sawhorse of the present invention.

FIG. 15 illustrates an end view and illustrates that the sawhorse 100*a* is in the open position. FIG. 15 illustrates the leg spacer 4, the flexible axis biasing device 5, the guide and stop 33 for the leg top, the leg latch 11 to maintain the legs 1, mirrored leg 1 in an open position, and a leg stabilizer notch 15.

Figure 15A:
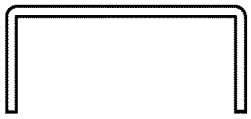
FIG. 15*a* illustrates a cross section of the leg of the present invention.

FIG. 15*a* illustrates a U-shaped cross-section of the legs 1, 2.

Figure 16:
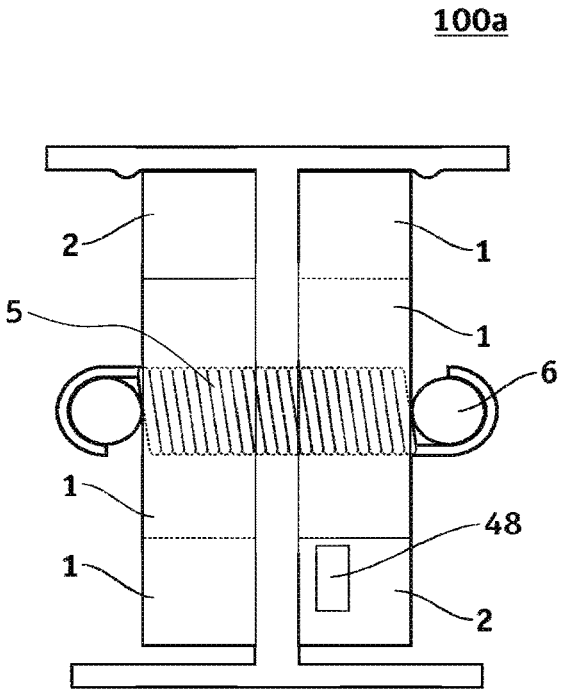
FIG. 16 illustrates an end view of the sawhorse of the present invention.

FIG. 16 illustrates a end view of the sawhorse 100*a* of the present invention and illustrates the first leg 1, the second leg, a receiver slot 48 that cooperates with the leg retainer sliding flat bolt to hold the leg against the beam in stowed position, the flexible axis biasing device 5 and the retainer pin 6.

Figure 17:
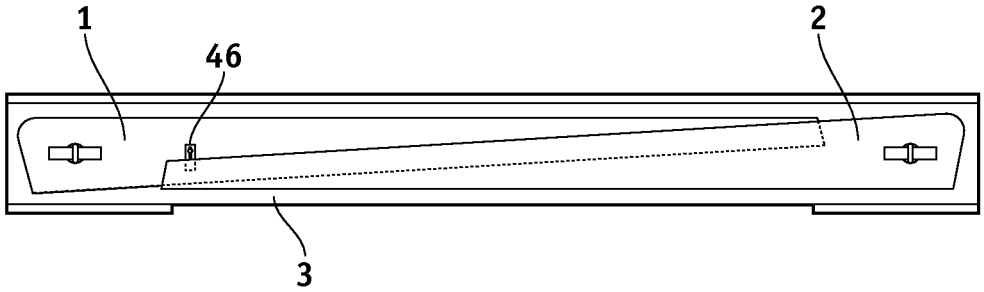
FIG. 17 illustrates the sawhorse of the present invention in a closed position.

FIG. 17 illustrates nesting legs 1, 2 which are in a stowed position FIG. 17 illustrates second leg 2 may be at an exterior position, first leg one may be between the second leg 2 and the center beam 3.

Figure 18:
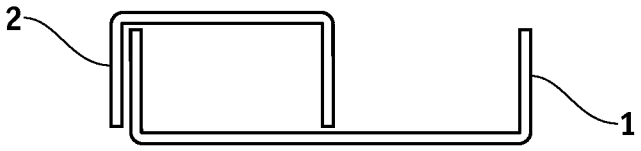
FIG. 18 illustrates a cross-sectional view of the first and second legs of the saw horse.

FIG. 18 illustrates a end view of the first leg 1 which may be substantially U-shaped and a opposed second leg 2 which may be substantially U-shaped. The first leg 1 may be nested with the second leg 2.

Figure 19:
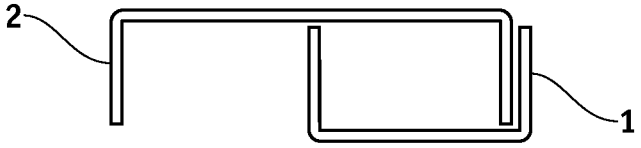
FIG. 19 illustrates another cross-sectional view of the first and second legs of the saw horse.

FIG. 19 illustrates an opposing end view of the first leg 1 which may be substantially U-shaped and a opposed second leg 2 which may be substantially U-shaped. The first leg 1 may be nested with the second leg 2.

Figure 20:
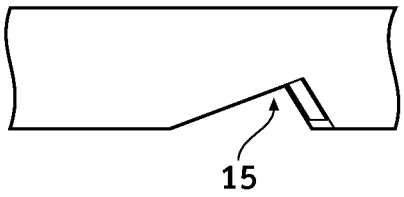
FIG. 20 illustrates a perspective view of a portion of a leg of the saw horse of the present invention.

FIG. 20 illustrates a side view of the leg 2 and the notch 15.

Figure 21:
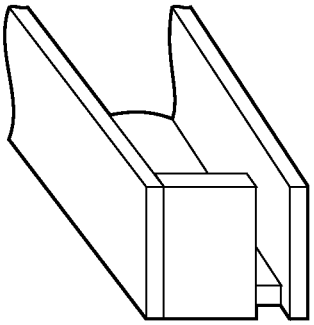
FIG. 21 illustrates a perspective view of the nesting legs of the saw horse of the present invention.

FIG. 21 illustrates a perspective view of the foot of a leg showing the gap that allows the legs to nest.

Figure 22:
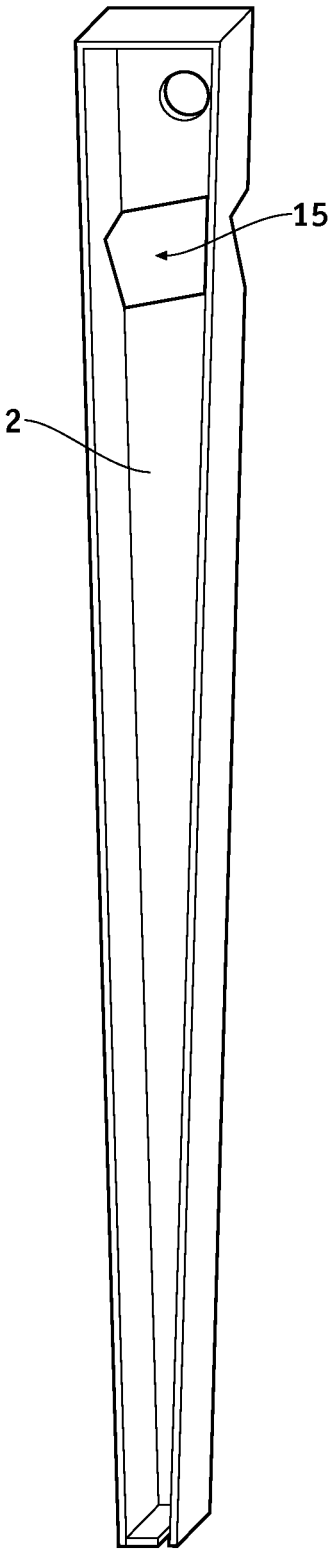
FIG. 22 illustrates a perspective view of a leg of the sawhorse of the present invention.

FIG. 22 illustrates a perspective view of the second leg 2 and the notch 15.

Figure 23:
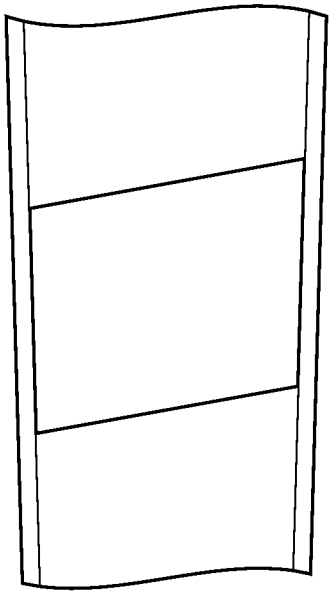
FIG. 23 illustrates a perspective view of the nesting legs of the sawhorse of the present invention.

FIG. 23 is a close up drawing of the void in the u-channel created by the retainer notch formation.

Figure 24:
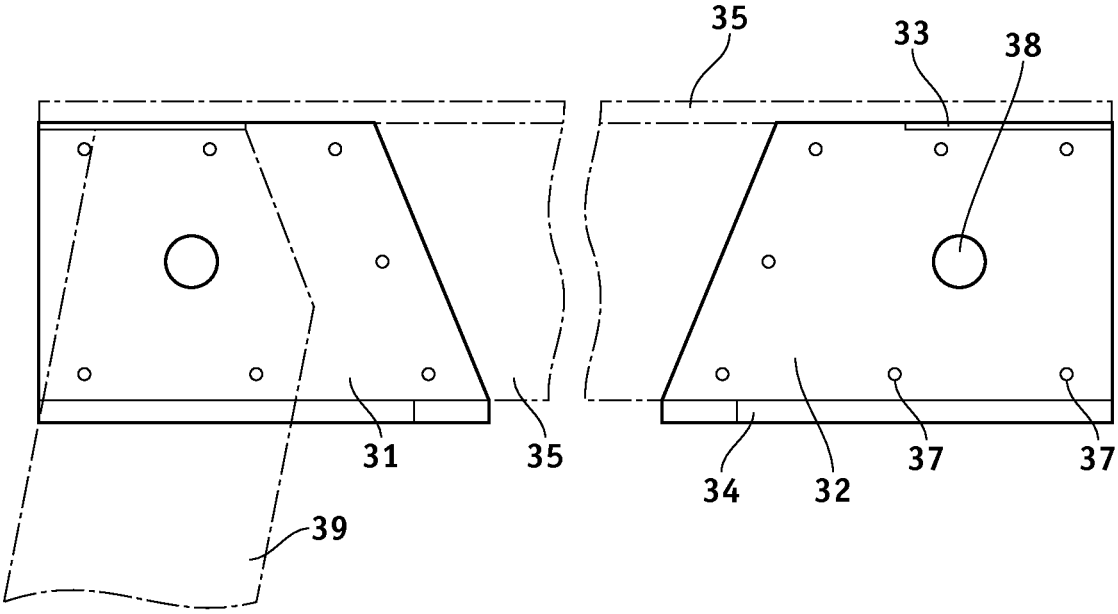
FIG. 24 illustrates a perspective view of a pair of brackets of the present invention.

FIG. 24 illustrates a first portion 31 of a bracket, a second portion 32 of the bracket, a guide and stop 33 for the leg top, a leg spreader 34 to spread and stabilize the legs, a beam 35, apertures 37, axis spring aperture 38, and a leg 39.

Figure 25:
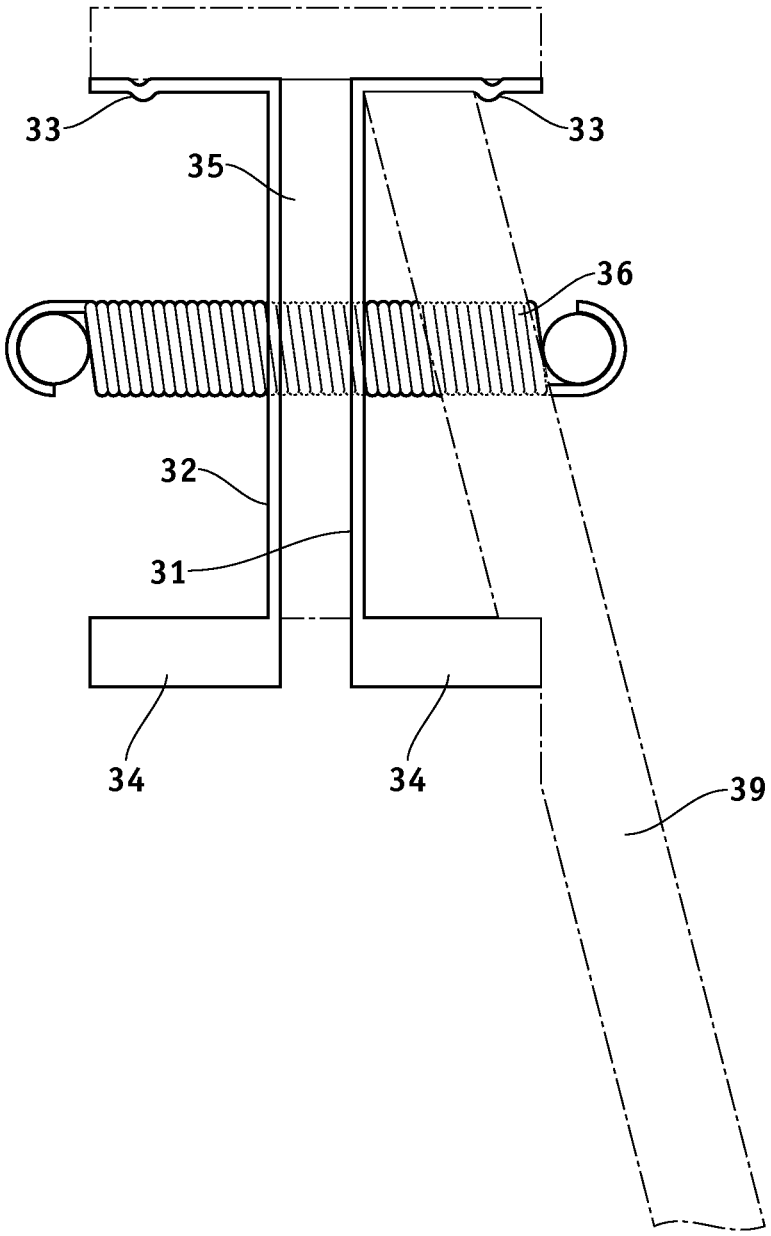
FIG. 25 illustrates an end view of the end of the sawhorse of the present invention.

FIG. 25 illustrates a first portion 31 of a bracket, a second portion 32 of the bracket, a guide and stop 33 for the leg top, a leg spreader 34 to spread and stabilize the legs, a beam 35, a flexible axis 36 and a leg 39.

Figure 27:
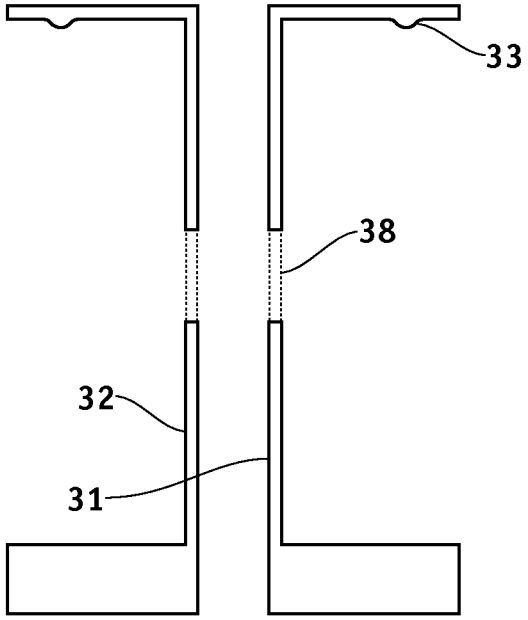
FIG. 27 illustrates an end view of the brackets of the present invention.

FIG. 27 is a cross-sectional view from the center of the beam looking out toward the end of the beam and illustrates a first portion 31 of a bracket, a second portion 32 of the bracket, a guide and stop 33 for the leg top, and axis spring aperture 38.

Figure 28:
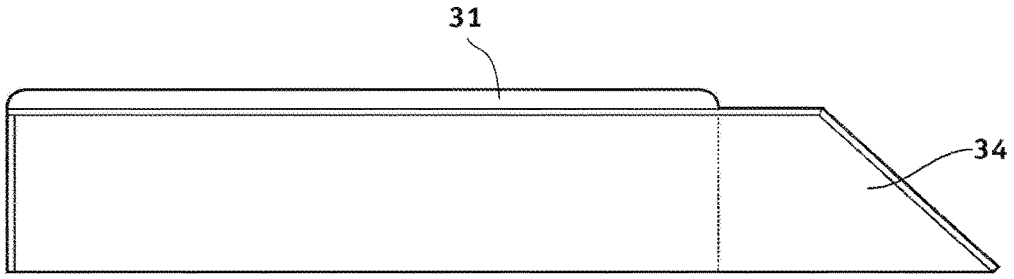
FIG. 28 illustrates a perspective view of the bottom of the bracket of the present invention.

FIG. 28 illustrates a bottom view of a portion 31 of a bracket showing a leg spreader 34 to spread and stabilize the legs.

Figure 29:
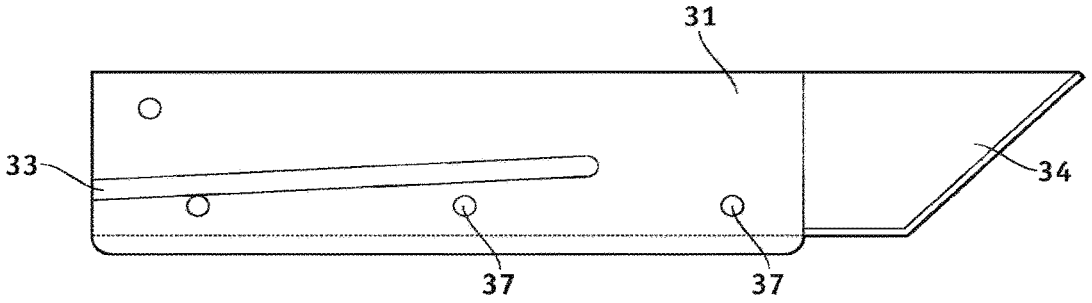
FIG. 29 illustrates a perspective of the top of the bracket of the present invention.

FIG. 29 illustrates a first portion 31 of a bracket, a guide and stop 33 for the leg top, a leg spreader 34 to spread and stabilize the legs, and apertures 37.

Figure 30:
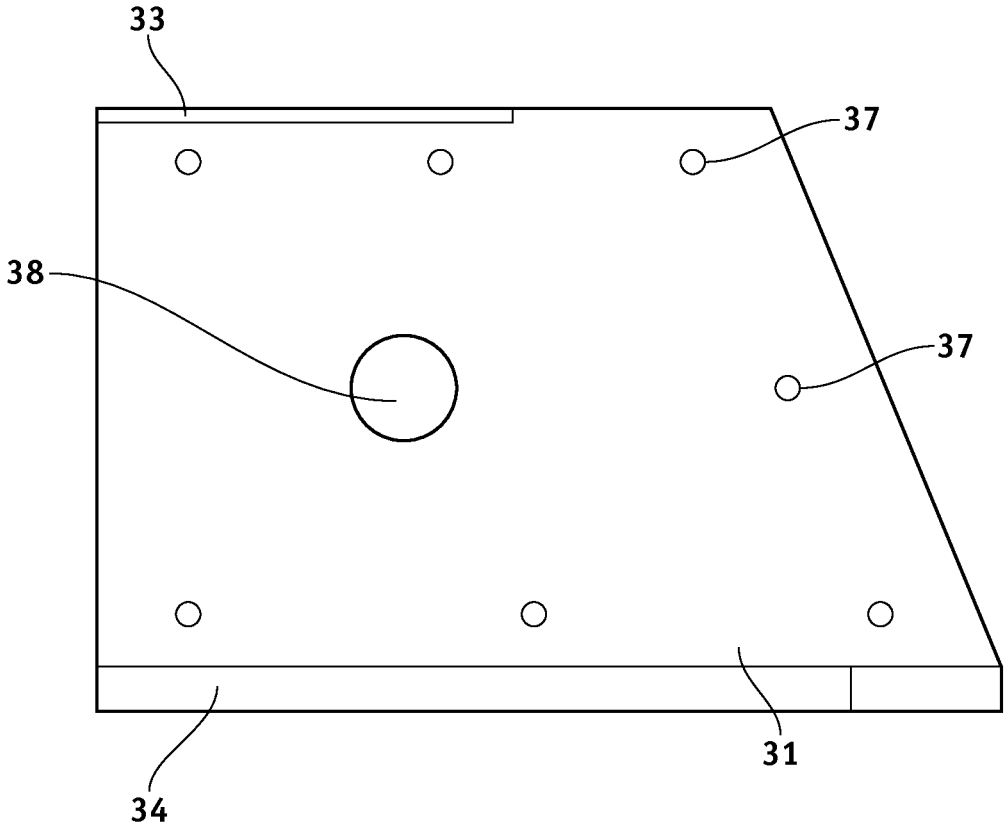
FIG. 30 illustrates a perspective view of the bracket of the present invention.

FIG. 30 illustrates a first portion 31 of a bracket, a guide and stop 33 for the leg top, a leg spreader 34 to spread and stabilize the legs, apertures 37, and axis spring aperture 38.

Figure 26:
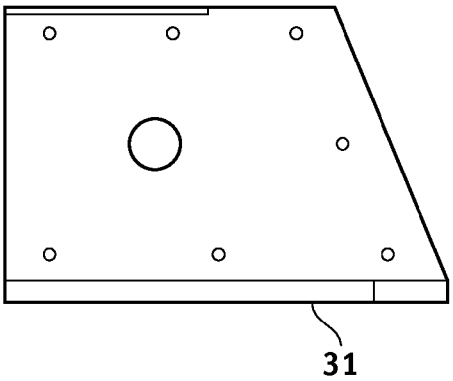
FIG. 26 illustrates a perspective view of a bracket of the present invention.

FIG. 26 illustrates the first portion 31 of the bracket.

Figure 31:
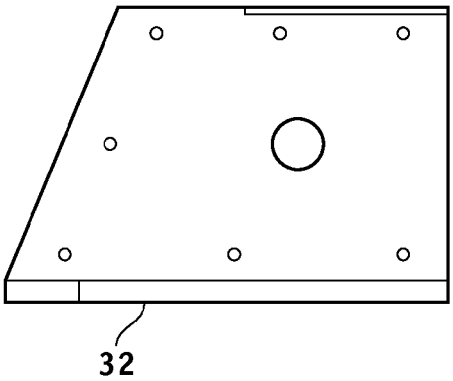
FIG. 31 illustrates a perspective view of the bracket of the present invention.

FIG. 31 illustrates the second portion 32 of the bracket.

Figure 32:
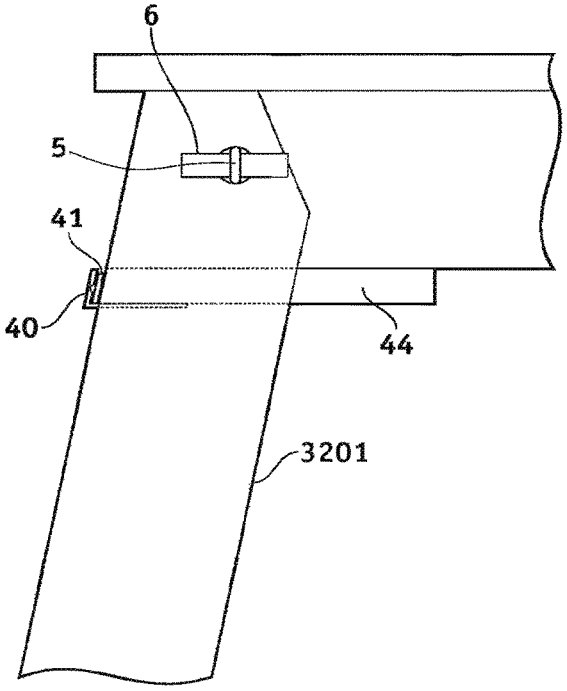
FIG. 32 illustrates a side view of the saw horse in the open position.

FIG. 32 illustrates a side view of the saw horse which may include a beveled leg spacer 44 which has beveled sides in order to cooperate with the legs 3201 in the open position. FIG. 32 further illustrates a leg latch 41 which is pivotally connected to one leg 3201. FIG. 32 also shows an angled stabilizer bracket 40 which cooperates with leg latch 41 to stabilize the legs 3201 in a traverse direction. The angled stabilizer bracket 40 defines a narrow slot in conjunction with the leg spacer 44 in which the leg latch 41 is positioned when the leg latch 41 connects the leg 3201 and its mirrored leg 3201 when the sawhorse is in the open position. FIG. 32 further illustrates the retainer pin 6 which secures the flexible axis biasing device 5 in place.

Figure 32A:
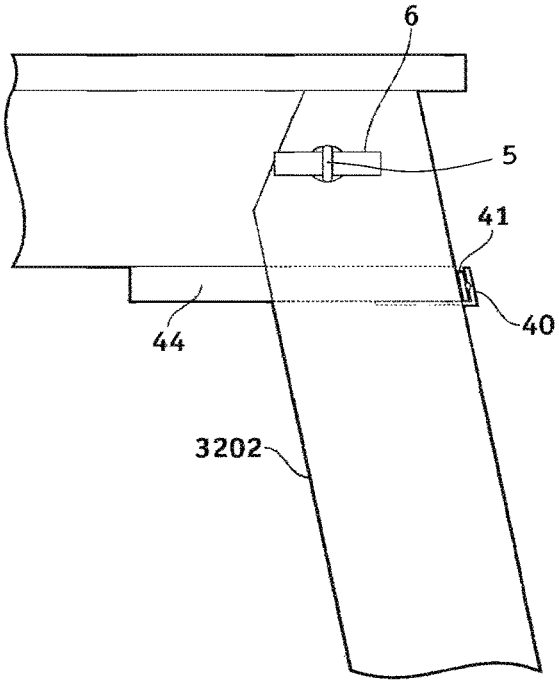
FIG. 32*a* illustrates another side view of the saw horse in the open position.
Figure 38:
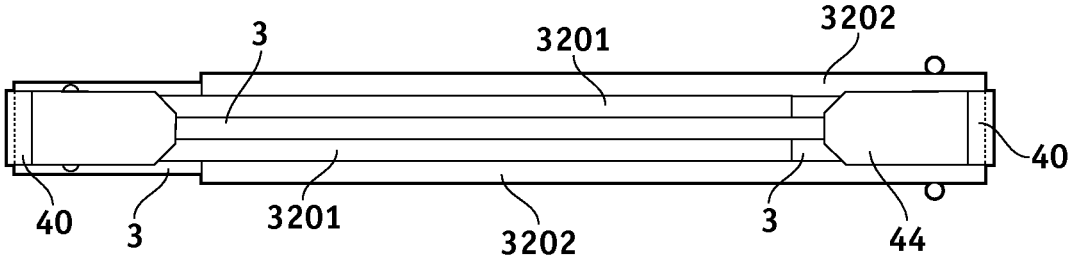
FIG. 38 illustrates a bottom view of the saw horse with a beveled leg spacer.

FIG. 32*a* illustrates a side view of one end of the saw horse, right end of FIG. 38, which may include a beveled leg spacer 44 which has beveled sides in order to cooperate with the legs 3202 in the open position. FIG. 32*a* further illustrates a leg latch 41 which is pivotally connected to one leg 3202. FIG. 32*a* also shows an angled stabilizer bracket 40 which cooperates with leg latch 41 to stabilize the legs 3202 in a traverse direction. The angled stabilizer bracket 40 defines a narrow slot in conjunction with the leg spacer 44 in which the leg latch 41 is positioned when the leg latch 41 connects the leg 3202 and its mirrored leg 3202 when the sawhorse is in the open position. FIG. 32*a* further illustrates the retainer pin 6 which secures the flexible axis biasing device 5 in place.

Figure 33:
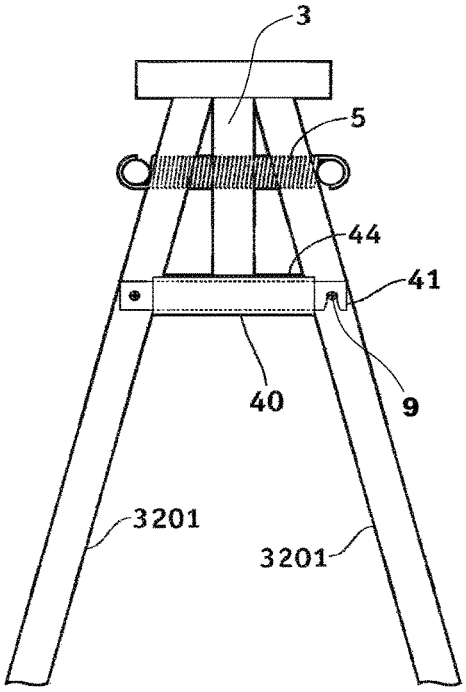
FIG. 33 illustrates a cross-sectional view of a portion of the end of the saw horse.

FIG. 33 illustrates an end view of the saw horse, left side in FIG. 38, with a beveled leg spacer 44 which has beveled sides to cooperate with the legs 3201 in the open position. FIG. 33 further illustrates a leg latch 41 which is pivotally connected to one leg and an angled stabilizer bracket 40 which cooperates with the leg latch 41 to stabilize the legs 3201 in a traverse direction. The angled stabilizer bracket 40 defines a narrow slot in conjunction with the leg spacer 44 in which the leg latch 41 is positioned when the leg latch 41 connects the leg 3201 and its mirrored leg 3201 in the open position. FIG. 33 also illustrates the catch 9 which cooperates with the leg latch 41 to connect the first leg 3201 to the mirrored first leg 3201 and the second leg 3202 to the mirrored second leg 3202, shown in FIG. 33*a*. FIG. 33 further illustrates the flexible axis biasing device 5 to connect the first leg 3201 to the mirrored first leg 3201 and to the beam 3.

Figure 33A:
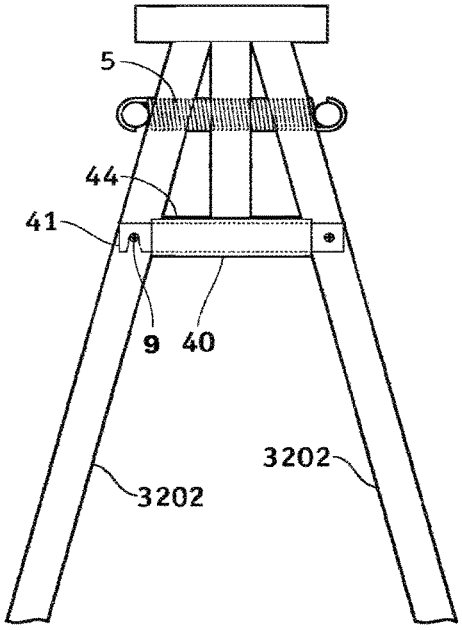
FIG. 33*a* illustrates cross-sectional view of a portion of the other end of the saw horse.

FIG. 33*a* illustrates an end view of the saw horse, right side in FIG. 38, with a beveled leg spacer 44 which has beveled sides to cooperate with the legs 3202 in the open position. FIG. 33*a* further illustrates a leg latch 41 which is pivotally connected to one leg and an angled stabilizer bracket 40 which cooperates with the leg latch 41 to stabilize the legs 3202 in a traverse direction. The angled stabilizer bracket 40 defines a narrow slot in conjunction with the leg spacer 44 in which the leg latch 41 is positioned when the leg latch 41 connects the leg 3202 and its mirrored leg 3202 in the open position. FIG. 33*a* also illustrates the catch 9 which cooperates with the leg latch 41 to connect the second leg 3202 to the mirrored second leg 3202, and the first leg 3201 to the mirrored first leg 3201, not shown in FIG. 33*a*. FIG. 33*a* further illustrates the flexible axis biasing device 5 to connect the second leg 3202 to the mirrored second leg 3202 and to the beam 3.

Figure 34:
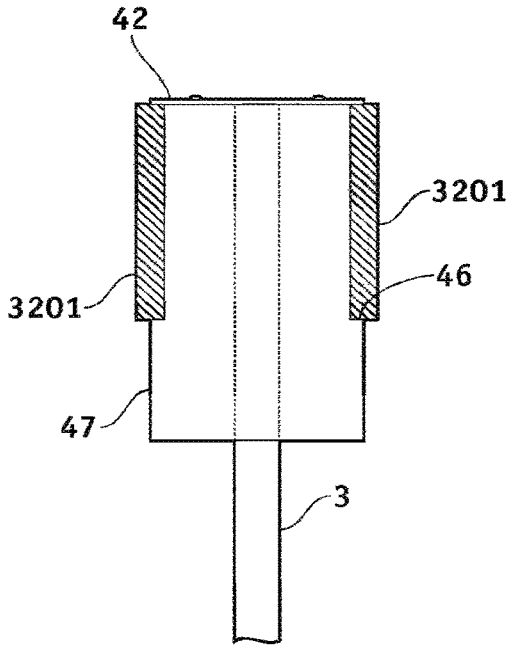
FIG. 34 illustrates a cross-sectional view of a portion of one end of the saw horse from the bottom.
Figure 39:
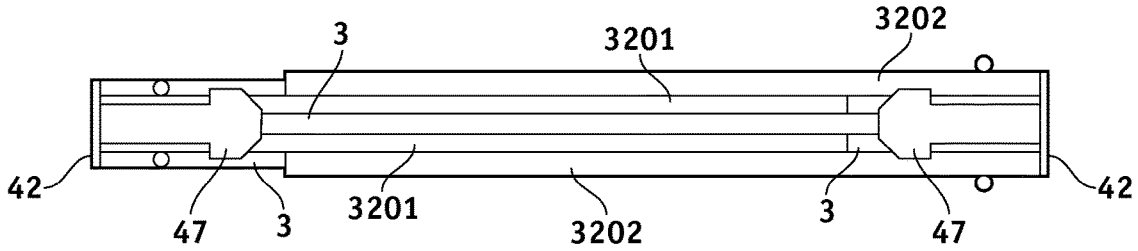
FIG. 39 illustrates a bottom view of the saw horse with a notched leg spacer.

FIG. 34 illustrates a bottom view and shows a cross section of a portion of one end of the saw horse, left side in FIG. 39, and illustrates the notched spacer 47 which may include opposing notches to cooperate with the legs when the saw horse is in the open position. FIG. 34 further illustrates the exterior stop 42 which cooperates with the interior stop 46 (a shoulder) to stabilize the legs 3201 in a traverse direction when the saw horse is in the open position.

Figure 34A:
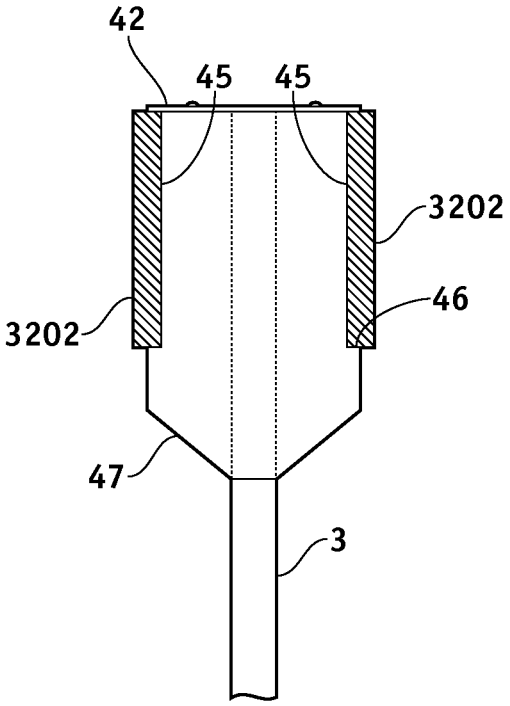
FIG. 34*a* illustrates a cross-sectional view of a portion of the other end of the saw horse from the bottom.

FIG. 34*a* illustrates a bottom view and shows a cross section of a portion of one end of the saw horse, right side in FIG. 39, and illustrates the notched spacer 47 which may include opposing notches to cooperate with the legs when the saw horse is in the open position. FIG. 34*a* further illustrates the exterior stop 42 which cooperates with the interior stop 46 (a shoulder) to stabilize the legs 3202 in a traverse direction when the saw horse is in the open position.

Figure 35:
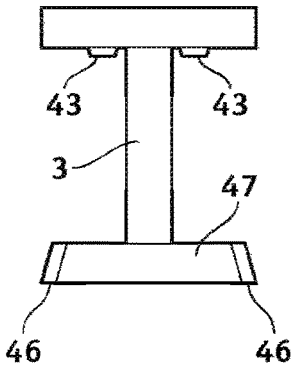
FIG. 35 illustrates a cross-sectional view of a portion of the end of the saw horse from the end.

FIG. 35 illustrates an end view of a cross section of a portion of the end of the sawhorse, left side in FIG. 39, from the end. FIG. 35 further illustrates the notched spacer 47, the interior stop 46, and the upper stop 43.

Figure 35A:
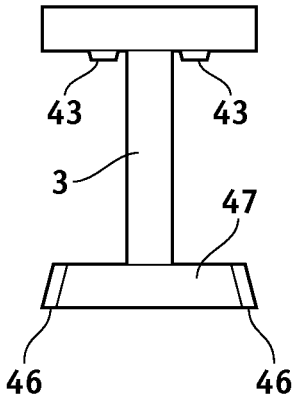
FIG. 35*a* illustrates a cross-sectional view of a portion of the other end of the saw horse from the end.

FIG. 35*a* illustrates an end view of a cross section of a portion of the end of the sawhorse, right side in FIG. 39, from the end. FIG. 35*a* further illustrates the notched spacer 47, the interior stop 46, and the upper stop 43.

Figure 36:
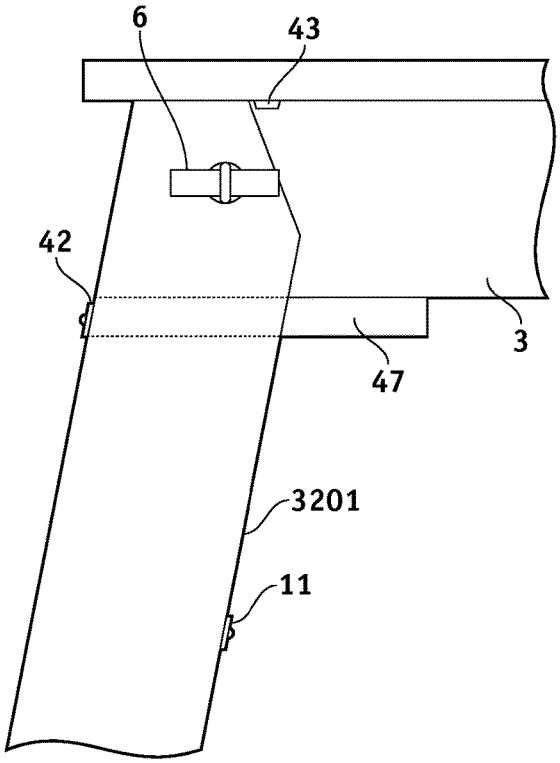
FIG. 36 illustrates a side view of one end of the saw horse.

FIG. 36 illustrates a side view of an end of the saw horse, left side in FIG. 39. FIG. 36 further illustrates the upper stop 43 and the exterior stop 42 which work in conjunction with each other and with the interior stop 46 to stabilize the legs in the open position. FIG. 36 also illustrates the leg latch 11 which connects and stabilizes the legs. FIG. 36 further illustrates the legs and the beam 3.

Figure 36A:
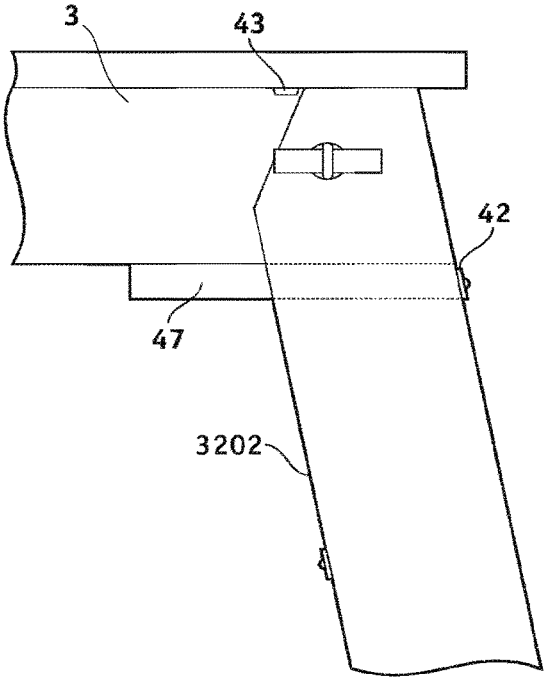
FIG. 36*a* illustrates a side view of the other end of the saw horse.

FIG. 36*a* illustrates a side view of an end of the saw horse, right side in FIG. 39. FIG. 36*a* further illustrates the upper stop 43 and the exterior stop 42 which work in conjunction with each other and with the interior stop 46 to stabilize the legs in the open position. FIG. 36*a* also illustrates the leg latch 11 which connects and stabilizes the legs. FIG. 36*a* further illustrates the legs and the beam 3.

Figure 37:
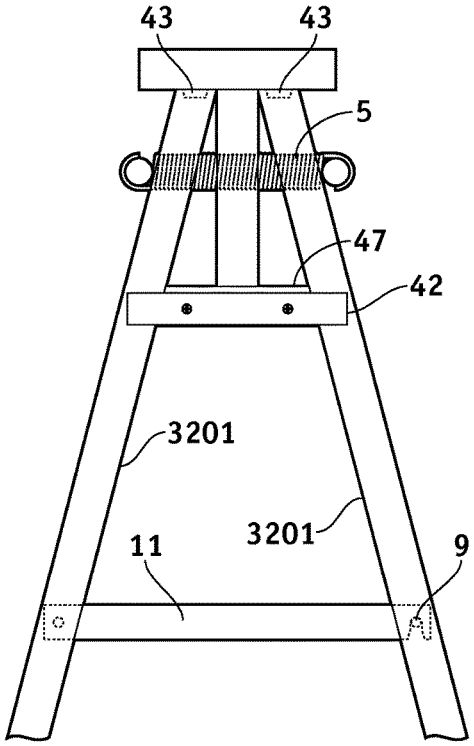
FIG. 37 illustrates a cross-sectional view of an end of the saw horse from the end.

FIG. 37 illustrates a cross sectional view of an end of the saw horse in the open position, left side in FIG. 39. FIG. 37 further illustrates the upper stop 43 and the exterior stop 42 which work in conjunction with each other and with the interior stop 46, as illustrated in FIG. 34, to stabilize the legs in the open position. FIG. 37 also illustrates the leg latch 11 detachably connected to the catch 9 to connect and stabilize the legs.

Figure 37A:
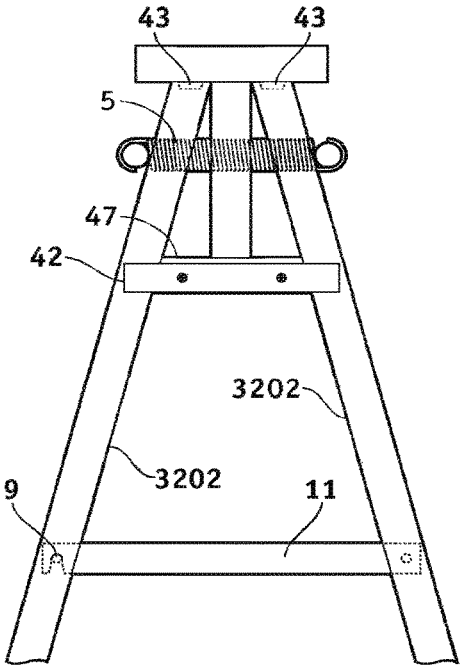
FIG. 37*a* illustrates a cross-sectional view of the other end of the saw horse from the end.

FIG. 37*a* illustrates a cross sectional view of an end of the saw horse in the open position, right side in FIG. 39. FIG. 37*a* further illustrates the upper stop 43 and the exterior stop 42 which work in conjunction with each other and with the interior stop 46, as illustrated in FIG. 34*a*, to stabilize the legs in the open position. FIG. 37 also illustrates the leg latch 11 detachably connected to the catch 9 to connect and stabilize the legs.

FIG. 38 illustrates a bottom view of the saw horse in the stowed position showing the center beam 3, the second leg 3202 on the outside and adjacent to the first leg 3201 which may be adjacent to the center beam 3 which may be adjacent to the mirrored first leg 3201, which may be adjacent to the mirrored second leg 3202, which may be on the outside. The beveled leg spacer 44 is additionally shown in FIG. 38. FIG. 38 further illustrates the angled stabilizer brackets 40 which cooperate with the leg latchs 41, not shown, to stabilize the legs 3202 and legs 3201 in a traverse direction when the saw horse is in the open position.

FIG. 39 illustrates a bottom view of the saw horse in the stowed position showing the center beam 3, the second leg 3202 on the outside and adjacent to the first leg 3201 which may be adjacent to the center beam 3 which may be adjacent to the mirrored first leg 3201, which may be adjacent to the mirrored second leg 3202, which may be on the outside. The notched leg spacer 47 is additionally shown in FIG. 39. FIG. 39 further illustrates the exterior stops 42 which work in conjunction with the upper stops 43, not shown in FIG. 39, and with the interior stop 46, not shown in FIG. 39, to stabilize the legs 3202 and legs 3201 in a traverse direction when the saw horse is in the open position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A saw horse comprising:
a beam;
a pair of legs each having a top end and a bottom end;
a flexible connector to rotatingly connect the pair of legs to the beam;
wherein the flexible connector allows rotation of the pair of legs between an open and stowed position,
wherein the stowed position disposes the legs along the beam;
wherein the open position disposes the legs downwardly and outwardly to support the beam;
wherein the flexible connector is configured and arranged to not bear a weight of a work piece supported by the beam when the saw horse is in the open position.

2. The saw horse of claim 1 further comprising:
a second pair of legs and a second flexible connector to connect the second pair of legs to the beam;
the pairs of legs rotate and traversely extend and retract to move between the positions;
the flexible connector is a spring adapted to flex when moving between the open and stowed positions;
the flexible connector passes through an aperture in the beam; and
the stowed position disposes two legs from the first or second pair of legs side-by-side on opposing peripheral sides of the beam and disposes the other two legs from the first or second pair of legs side-by-side on opposing sides of the legs disposed along the beam.

3. The saw horse of claim 2 further comprising:
a stabilizer to stabilize the pair of legs and the leg spacer while in the open position.

4. The saw horse of claim 3 wherein:
the stabilizer comprises notches disposed on the pair of legs.

5. The saw horse of claim 2 further comprising:
a flexible handle connected to the center beam
a leg latch; and
a leg latch catch.

6. The saw horse of claim 1 wherein:
the flexible connector passes through an aperture in the beam.

7. The saw horse of claim 1 further comprising:
a second pair of legs and a second flexible connector to connect the second pair of legs to the beam;
the stowed position disposes two legs from the first or second pair of legs side-by-side on opposing peripheral sides of the beam and disposes the other two legs from the first or second pair of legs side-by-side on opposing sides of the legs disposed along the beam.

8. The saw horse of claim 1 wherein:
wherein the sawhorse is structured and arranged to support a weight of the workpiece supported by the beam while the saw horse is in the open position even when the flexible connectors are absent from the saw horse.

9. The saw horse of claim 8 wherein:
the beam comprises a leg spacer;
the pair of legs rotates and traversely extends and retracts to move between the open and the stowed position;
the flexible connector is adapted to pull together the top ends to lever the pair of legs against the leg spacer thereby extending the bottom ends outward from each other while moving to the open position; and
the flexible connector flexes when moving between the positions.

10. The saw horse of claim 9 wherein:
the flexible connector comprises a spring.

11. A saw horse to support a work piece comprising:
a beam to support the work piece;
a first pair of legs to support the beam and the work piece;
a first flexible connector to attach the first pair of legs to one end of the beam with one leg on either side of the beam;
a second pair of legs to support the beam and the work piece;
a second flexible connector to attach the second pair of legs to the other end of the beam with one leg on either side of the beam;
wherein the flexible connectors are adapted to rotate the pairs of legs between an open position and a nested position,
wherein the open position extends the legs to support the beam,
wherein the nested position disposes two legs from the first or second pair of legs side-by-side on opposing peripheral sides of the beam and disposes the other two legs from the first or second pair of legs side-by-side on opposing sides of the legs disposed along the beam;
wherein the flexible connectors are configured and arranged to not bear a weight of the work piece supported by the beam when the saw horse is in the open position.

12. The saw horse of claim 11 wherein:
the flexible connectors are springs adapted to flex when moving between the open and nested positions;
the flexible connectors pass through apertures in the beam; and
the flexible connectors, when in the open position, pull together the top ends to lever the pairs of legs against the beam thereby extending the bottom ends outward from each other.

13. A saw horse to support a work piece comprising:
a beam to support the work piece, wherein the beam comprises at least a portion of a T shape;
a first pair of legs to support the beam and the work piece;
a first flexible connector to attach the first pair of legs to one end of the beam with one leg on either side of the beam;
a second pair of legs to support the beam and the work piece;
a second flexible connector to attach the second pair of legs to the other end of the beam with one leg on either side of the beam;
wherein the flexible connectors are adapted to rotate the pairs of legs between an open position and a nested position,
wherein the open position extends the legs to support the beam,
wherein the nested position nests the legs entirely within a bounding box that most narrowly confines the beam;
wherein the flexible connectors are configured and arranged to not bear a weight of the work piece placed on the beam when the saw horse is in the open position.

14. The saw horse of claim 13 wherein:
wherein the sawhorse is structured and arranged to support a weight of the workpiece supported by the beam while the saw horse is in the open position even when the flexible connectors are absent from the saw horse.

15. The saw horse of claim 14 wherein:
the nested position disposes two legs from the first or second pair of legs side-by-side on opposing peripheral sides of the beam and disposes the other two legs from the first or second pair of legs side-by-side on opposing sides of the legs disposed along the beam
the beam comprises at least a portion of an I shape;
wherein the nested position nests the legs within the boundary formed by the edges of the I shape.

16. The saw horse of claim 15 wherein:
the flexible connectors are springs adapted to flex when moving between the open and nested positions;
the flexible connectors passes through apertures in the beam; and
the flexible connectors are adapted to pull together the top ends to lever the pairs of legs against the beam thereby extending the bottom ends outward from each other.

17. A saw horse to support a workpiece comprising:
a beam to support the workpiece, wherein at least a portion of the beam comprises an I shape;
a pair of legs to support the beam, wherein each of the legs has a top end and a bottom end; and
a spring to attach the pair of legs to the beam with one leg on either side of the beam;
wherein the spring is adapted to pull the top ends of the pair of legs inwardly;
wherein the beam, the pair of legs, and the spring are configured and arranged to bear the weight of the work piece supported by the beam only along the beam and the pair of legs and to not bear the weight of the workpiece along the spring.

18. The saw horse of claim 17 wherein:
the spring passes through an aperture in the beam; and
the pair of legs is adapted to pivot around a lower portion of the I shape until the top ends of the legs hold against a upper portion of the I shape.

19. The saw horse of claim 18 wherein:
the pair of legs is adapted to pivot away from the lower portion of the I shape to dispose the legs side-by-side on opposing peripheral sides of the beam.

20. The saw horse of claim 19 further comprising:
a latch to latch together the pair of legs;
wherein the pair of legs is adapted to pivot around the lower portion of the I shape while engaging the spring until the top ends of the legs hold against the upper portion of the I shape and while the latch latches the legs in place.

21. The saw horse of claim 19 further comprising:
at least one stabilizer on each leg to stabilize the pair of legs and the beam, whenever the pair of legs is in the open position, wherein the stabilizer mates flush with the lower portion of the I shape.

22. The saw horse of claim 21 further comprising:
the stabilizer comprises at least one notch.

23. A saw horse to support a workpiece comprising:
a beam to support the workpiece, wherein at least a portion of the beam comprises an I shape with a workpiece-supporting flange and a leg-separating flange;
four legs positioned on opposite sides and opposite ends of the beam, wherein the legs have top ends and bottom ends; and
at least two flexible connectors to attach the top ends of the legs to the beam between the flanges;
wherein the flexible connectors are adapted to rotate the legs between a nested position and an open position and the flexible connectors flex when moving between the positions;
wherein the nested position disposes the legs and the beam flat against each other;
wherein the nested position further disposes the legs between the flanges;
wherein the open position disposes the legs angularly opposed to the beam;
wherein the open position further disposes at least a portion of the legs flush with at least a portion of at least one of the flanges such that a weight of the workpiece upon the beam transfers directly to the legs;
wherein, when the legs move from the nested to the open position, the flexible connectors pull the top ends of the legs together to spread the bottom ends by levering against the leg-separating flange;
wherein the sawhorse is structured and arranged to support a weight of the workpiece supported by the beam while the saw horse is in the open position even when the flexible connectors are absent from the saw horse.

24. The sawhorse of claim 23 wherein:
the flexible connectors are springs.

25. The sawhorse of claim 23 wherein:
the flexible connectors are flexible axis biasing devices.

26. The sawhorse of claim 23 further comprising:
at least one notch disposed on each leg, wherein, when in the open position, the notch mates flush with at least one surface of the leg-separating flange.

27. The sawhorse of claim 23:
wherein, when the legs are in the open position, the top ends of the legs comprise at least one flat surface to lay flat with underside of the workpiece-supporting flange.

28. The sawhorse of claim 23 further comprising:
at least two apertures in the beam to allow the flexible connectors to pass through the beam to connect the legs to the beam in pairs.

29. The sawhorse of claim 28 further comprising:
at least two latches to latch together the pairs of legs below the leg-separating flange when the legs are in the open position.

30. The sawhorse of claim 29 further comprising:

at least one notch disposed on each leg, wherein, when in the open position, the notch mates flush with at least one surface of the leg-separating flange;

wherein, when the legs are in the open position, the top ends of the legs comprises at least one flat surface to lay flat with underside of the workpiece-supporting flange;

wherein the flexible connectors are springs.

* * * * *